US010562053B2

(12) United States Patent
Maas et al.

(10) Patent No.: US 10,562,053 B2
(45) Date of Patent: Feb. 18, 2020

(54) LIQUID DISPENSING DEVICE HAVING A PRE-COMPRESSION OUTLET VALVE

(71) Applicant: Dispensing Technologies B.V., Helmond (NL)

(72) Inventors: Wilhelmus Johannes Joseph Maas, Someren (NL); Paulo Nervo, Hoogeloon (NL)

(73) Assignee: Dispensing Technologies B.V., Helmond (NL)

( * ) Notice: Subject to any disclaimer, the term of this patent is extended or adjusted under 35 U.S.C. 154(b) by 65 days.

(21) Appl. No.: 15/112,675

(22) PCT Filed: Feb. 26, 2015

(86) PCT No.: PCT/EP2015/054101
§ 371 (c)(1),
(2) Date: Jul. 19, 2016

(87) PCT Pub. No.: WO2015/128446
PCT Pub. Date: Sep. 3, 2015

(65) Prior Publication Data

US 2017/0072416 A1 Mar. 16, 2017

Related U.S. Application Data

(60) Provisional application No. 61/945,092, filed on Feb. 26, 2014.

(51) Int. Cl.
*B05B 11/00* (2006.01)

(52) U.S. Cl.
CPC ..... *B05B 11/3061* (2013.01); *B05B 11/304* (2013.01); *B05B 11/3014* (2013.01)

(58) Field of Classification Search
CPC ..... B05B 11/3012; B05B 11/3014; B05B 11/3061; B05B 11/304; F04B 39/0016; F04B 53/12
USPC ..... 222/494, 491
See application file for complete search history.

(56) References Cited

U.S. PATENT DOCUMENTS 4,964,547 A * 10/1990 Lina ..... B05B 11/0059 222/385
5,092,495 A * 3/1992 Andre ..... B05B 11/3088 222/321.2
5,401,148 A 3/1995 Foster et al.
5,425,476 A * 6/1995 Montaner ..... B05B 11/3011 222/383.1

(Continued)

FOREIGN PATENT DOCUMENTS

| | | |
|---|---|---|
| EP | 0453387 | 10/1991 |
| WO | WO2002094108 | 11/2002 |
| WO | WO2014074654 | 5/2014 |

*Primary Examiner* — Paul R Durand
*Assistant Examiner* — Robert K Nichols, II
(74) *Attorney, Agent, or Firm* — Rudy J. Ng; Bret E. Field; Bozicevic, Field & Francis LLP

(57) ABSTRACT

Provided is a liquid dispensing device that includes: a piston chamber; a piston that is moveable within the piston chamber to pressurize a liquid to be dispensed; a nozzle with a defined throughput for dispensing the liquid; an outlet valve having a defined minimum opening pressure arranged between the piston chamber and the nozzle; and a prime valve for priming the device, where the prime valve may be mechanically operable and may be arranged on or in the piston.

20 Claims, 18 Drawing Sheets

(56) References Cited

U.S. PATENT DOCUMENTS

| | | | | |
|---|---|---|---|---|
| 5,626,264 | A * | 5/1997 | Florez | B05B 11/3018 222/321.2 |
| 6,695,225 | B2 * | 2/2004 | Yanagida | B05B 11/3059 239/124 |
| 7,717,303 | B2 * | 5/2010 | Rampini | B05B 11/0041 222/321.2 |
| 9,788,993 | B2 * | 10/2017 | Yoshimura | B65D 47/18 |
| 2007/0221686 | A1 * | 9/2007 | Bae | A45D 34/02 222/409 |

* cited by examiner

LIQUID DISPENSING DEVICE HAVING A PRE-COMPRESSION OUTLET VALVE

TECHNICAL FIELD

The present invention relates to dispensing technologies, and in particular to improved sprayers or foam dispensers of various types, wherein output pressure, and thus droplet size, can be precisely controlled, wherein sprayers can be efficiently primed to remove air form the pumping system, and where outlet valves optimally perform with minimal hysteresis.

In particular, the invention relates to a liquid dispensing device comprising: a piston chamber; a piston that is moveable within the piston chamber to pressurise a liquid to be dispensed; a nozzle with a defined throughput for dispensing the liquid; an outlet valve having a defined minimum opening pressure arranged between the piston chamber and the nozzle; and a prime valve for priming the device. Such a liquid dispensing device is disclosed in applicant's earlier application PCT/US2013/068825, which was later published as WO 2014/074654 A1.

BACKGROUND OF THE INVENTION

Liquid dispensing devices such as spray bottles are well known. Some offer pre-compression so as to insure a strong spray when the trigger is pulled and prevent leakage. Sprayers and foamers can be easily manufactured and filled, and are often used to dispense cleaners of all types, for example. However, in many circumstances it is preferred not to have to continually pump a dispensing device to push out the dispensed liquid. Rather, it would be much more convenient to be able to continue the spray or foam substantially past the user pulling a trigger or otherwise actuating the sprayer head. For example, if by actuating a sprayer head a certain reasonable number of times per minute a continuous spray could be obtained, many users would find that optimal.

One set of dispensing devices that provide a continuous spray are aerosol dispensers, such as are used for cooking spray (e.g. Pam®), insect spray (e.g. Raid®), lubricants (e.g. WD-40®), and a host of other uses. Aerosols hold a liquid or other dispensate under pressure such that when a user activates the device (e.g., by pressing a button) the pressurized contents are allowed to escape. However, aerosols present both significant environmental hazards as well as packaging drawbacks, which result from the necessity of using an aerosol propellant in them, and the further necessity of pressurizing them. This requires filling such devices under pressure, using packaging strong enough to withstand the pressure, and taking steps to insure that the propellant maintains a uniform pressure over the life of the can or container. Such conditions often require use of non-environmentally friendly materials and ingredients.

Additionally, conventional aerosols do not continue spraying unless the user keeps their finger on the button. Inasmuch as people generally push on the aerosol can with the index finger of their dominant hand, this requirement precludes their ability to do anything with the spray or the surface/object on which the spray is directed with that hand making it difficult to clean, etc. Thus, users are forced to spray, for example, a cleaner on a surface, then stop spraying, then wipe or scrub, etc.

Recently floor cleaning products have emerged to replace mops. Many try to spray a cleaning fluid or floor care product from one or more nozzles while a user is pushing the device along the floor or surface. Some of these devices utilize a motorized pump, run by a power cord or battery. However, such devices are often not robust, and do not last long. Or, for example, in the case of battery powered floor cleaners, any serious current draw requires large batteries, and frequent changing of same, which is both environmentally unfriendly, cumbersome and expensive.

Finally, although conventional pre-compression sprayers control the minimum output pressure, they do not in any way control the maximum output pressure. A conventional sprayer starts dispensing at a low pressure. During a trigger stroke, the pressure rises up to a peak pressure. The liquid is forced through an orifice, but only a part of the liquid can pass the nozzle, so the pressure will build up within the sprayer. Towards the end of the stroke, the liquid pressure drops to zero. The low pressure at the beginning and end of the stroke thus creates larger, non-uniform droplets at the right and left sides of the conventional sprayer pressure time curve.

A pre-compression sprayer starts spraying when the liquid pressure is at a pre-determined pressure. This pre-determined pressure is known as the "cracking pressure" of the outlet valve. As noted, during a trigger stroke the pressure rises to a peak pressure. When the pressure drops to a predetermined pressure (closing pressure of the outlet valve) dispensing stops immediately. The droplet size at the beginning and end of a dispensing stroke in a pre-compression sprayer are smaller because the pressure is higher. The peak pressure, creating even smaller droplets, is also higher than that of a conventional sprayer, because the same amount of liquid is dispensed in a shorter time. Therefore more pressure builds up. Thus, relative to a conventional sprayer the pressure difference across the pressure time curve will still be there and even be greater. It is only shifted to a higher pressure range. Thus, difficulties with standard pre-compression sprayers include, for example, (1) wider spreading droplet sizes, and (2) too small droplet sizes.

Additionally, in "direct action" type sprayers, where a user wants the spray to cease as soon as he or she stops triggering, it is desirable that the pre-compression outlet valve have a binary action, i.e. it closes effectively immediately. To achieve this, the pressure difference between opening and closing pressures of the outlet valve is optimally small. Conventionally, however, this is not the case.

In order to control outlet pressures of droplets, and to also allow for continuous spray between trigger strokes (thus imitating the operative functionality of aerosol sprayers), a buffer may be used in combination with a pre-compression valve. This results in a precise band of outlet pressures, and moves the upper portion of the pressure-time curve to the time interval between downstrokes, as described in detail in WO 2014/074654 A1 referenced above. However, when such a combination is implemented, a pre-compression valve, which sets the minimum output pressure, may require a significant opening pressure. This makes priming an issue, as to evacuate the air in the pump through the outlet valve requires sufficiently compressing it to reach the opening pressure of the outlet valve. If there are a number of interior channels, such as those providing a liquid path around the internal in-line buffer, as well as other channels, which are not compressible, a priming system is desirable that does not require venting trapped air through the normal spray outlet channel by opening a pre-compression valve.

SUMMARY OF THE INVENTION

In accordance with an aspect of the invention, a liquid dispensing device of the type described above is provided, wherein the prime valve is mechanically operable and is arranged on or in the piston. Mechanical operation of the prime valve allows the pump to be efficiently primed, even though air in the pump cannot be pressurised to the cracking pressure of the outlet valve, while arrangement of the prime valve on or in the piston allows for an easy discharge of the air from the piston chamber.

In one embodiment the liquid dispensing device further comprises an operating member in the piston chamber which is arranged to move the prime valve from a closed position to an open position when the moveable piston is near or at an end of its stroke. In this way the prime valve is opened only at the end of the stroke, when the air is fully pressurised.

This operation may be achieved in a structurally simple manner when the operating member protrudes from an end wall of the piston chamber.

In order to allow the air to be discharged from the piston chamber swiftly and effectively the liquid dispensing device may comprise a plurality of operating members.

An embodiment of the prime valve which is structurally simple comprises a sealing part closing off an orifice in the piston and an actuating part connected to the sealing part and arranged to cooperate with the operating member. By dispensing the air through the orifice in the piston a relatively short flow path is obtained.

The sealing part may be deformable together with the actuating part when the actuating part is engaged by the operating member. A deformable prime valve is easier to manufacture and simpler to operate than a valve that is hinged or otherwise movable.

In order to allow substantially all the air to be removed from the device during priming, an end wall of the piston chamber and/or the piston may comprise an air flow path leading to the prime valve.

In one embodiment of the liquid dispensing device of the invention the prime valve may be arranged to be biased towards an open position when a pressure in the piston chamber exceeds a predetermined value. In this way the prime valve may also serve as an overpressure relief valve that will open when the pressure within the piston chamber reaches values that are critically high.

This may be achieved in relatively simple manner when the sealing part is oriented away from an end wall of the piston chamber.

In another embodiment of the inventive liquid dispensing device the prime valve is arranged to be biased towards a closed position by a pressure in the piston chamber. In this way leakage of liquid through the prime valve during regular operation of the device may be prevented.

Such leakage prevention may be achieved by orienting the sealing part towards an end wall of the piston chamber.

In order to obtain an even pressure distribution and consequently a uniform discharge pattern, the piston chamber may be cylindrical, the piston may have a circular circumference and the prime valve may be annular, wherein the sealing part of the prime valve may be formed by an outer peripheral edge portion thereof.

In such a liquid dispensing device the actuating part may then comprise an annular rim that is concentric with the sealing part and has a smaller diameter than the sealing part.

In this arrangement the sealing part and the actuating part may have substantially parallel orientations when the prime valve is also used as an overpressure valve.

Alternatively, the sealing part and the actuating part may have substantially opposite orientations in case the prime valve is arranged to prevent leakage of pressurised liquid when the device is normally operated.

In order to allow the air to be swiftly and easily discharged from piston chamber during priming, the liquid dispensing device may further comprise a return opening in a side wall of the piston chamber, while the piston may comprise a first circumferential seal for sealing a part of the piston chamber between the piston and a piston chamber end wall and a second circumferential seal spaced apart from the first circumferential seal, such that when the piston is at or near an end of its stroke the return opening is located between the first and second circumferential seals. In this way the space between the first and second seals may serve to collect and discharge the air that is to be removed from the device.

When the container is not a Flair® type container but rather a conventional container, the liquid dispensing device may further comprise a vent opening in the side wall of the piston chamber, and the first and second circumferential seals may be located between the vent opening and the piston chamber end wall when the piston is at or near an end of its stroke. In this way the container may be vented to prevent a (partial) vacuum from developing, and the vent opening may be opened at the end of the stroke, when the seals have passed by the vent opening.

In accordance with another aspect of the invention a liquid dispensing device may be provided wherein the outlet valve may be configured to minimize a difference between its opening pressure and its closing pressure. In this way hysteresis is minimized.

To this end the outlet valve may comprise a dome and the dome may have a stiffness which varies in radial direction.

In one embodiment of this liquid dispensing device the dome valve may have an inner flexible portion surrounding its center and an outer stiffer portion. This particular stiffness distribution is believed to provide advantageous valve characteristics.

This stiffness distribution may be obtained by simple means when the dome valve is thinnest in the inner flexible portion, having a radius $R_1$, and gets thicker as the radius increases beyond $R_1$.

In order to allow the liquid dispensing device to mimic the characteristics of an aerosol dispenser, it may further comprise a buffer arranged between the piston chamber and the outlet valve.

A complete, ready-to-use liquid dispensing device is obtained when the device further comprises a container for the liquid to be dispensed, the container being in fluid communication with the piston chamber through an inlet valve. In this embodiment the various functional elements may be arranged on or integrated into a dispensing head, which may be mounted on the container. In a variant, one or more of the functional elements may be arranged on or integrated in the container, thus providing so-called "lock-out" features which prevent the applicant's dispensing head from being retrofitted to a container from a competitor.

BRIEF DESCRIPTION OF DRAWINGS

The invention is illustrated by way of a number of exemplary embodiments, with reference being made to the annexed drawings, in which like elements are identified by reference numerals which are increased by "100". In these drawings.

DETAILED DESCRIPTION OF THE INVENTION

In exemplary embodiments of the present invention, various novel sprayers and related dispensing devices are presented. The sprayer heads shown can, in general, work with both standard bottles or reservoirs and with the "bag within a bag" or "container within a container" Flair® technology developed and provided by the applicant. The "bag within a bag" Flair® technology, which causes the inner container to shrink around the product, thus obviates headspace or air bubbles in the inner container. Because in Flair® technology the pressure applied to the inner bag results from a pressurizing medium, often atmospheric pressure vented between said inner and outer containers, venting of the liquid container is not required. Of course, whenever a product is dispensed from an inner bag in a Flair® system, which shrinks to the remaining volume of the product as it dispenses, then the pressure has to be equalized in the gap between the outer container and the inner container. This can be done, for example, using a displacing medium, such as, for example, air, whether at atmospheric pressure or higher. This can easily be done by venting the gap to ambient air somewhere between the inner container and the outer container, for example, by providing a vent on the bottom of the Flair® container, or at any other convenient position of the outer container. In some exemplary embodiments such a vent may be moved to the sprayer head itself.

There is an intimate relationship between output pressure and time of the outflow of various types of sprayers. In a conventional sprayer there is a distribution of output pressures, essentially a Gaussian curve (FIG. 1A), and with greater pressure there is a smaller droplet size. Thus, in the pressure curve of conventional sprayer there is a distribution of droplet sizes as illustrated by the irregularly dotted area. A conventional sprayer has no closed valves. When the piston is actuated the sprayer immediately starts dispensing. Thus, slow actuation of the pump by a user results in large droplets or drips and the liquid pressure is low. On the other hand, fast actuating of the piston can decrease the amount of large droplets because the pressure then rises more quickly towards the peak pressure. Thus, in a conventional sprayer performance is highly dependent upon the user operating or the behavior of the user operating the sprayer.

Figure 1:
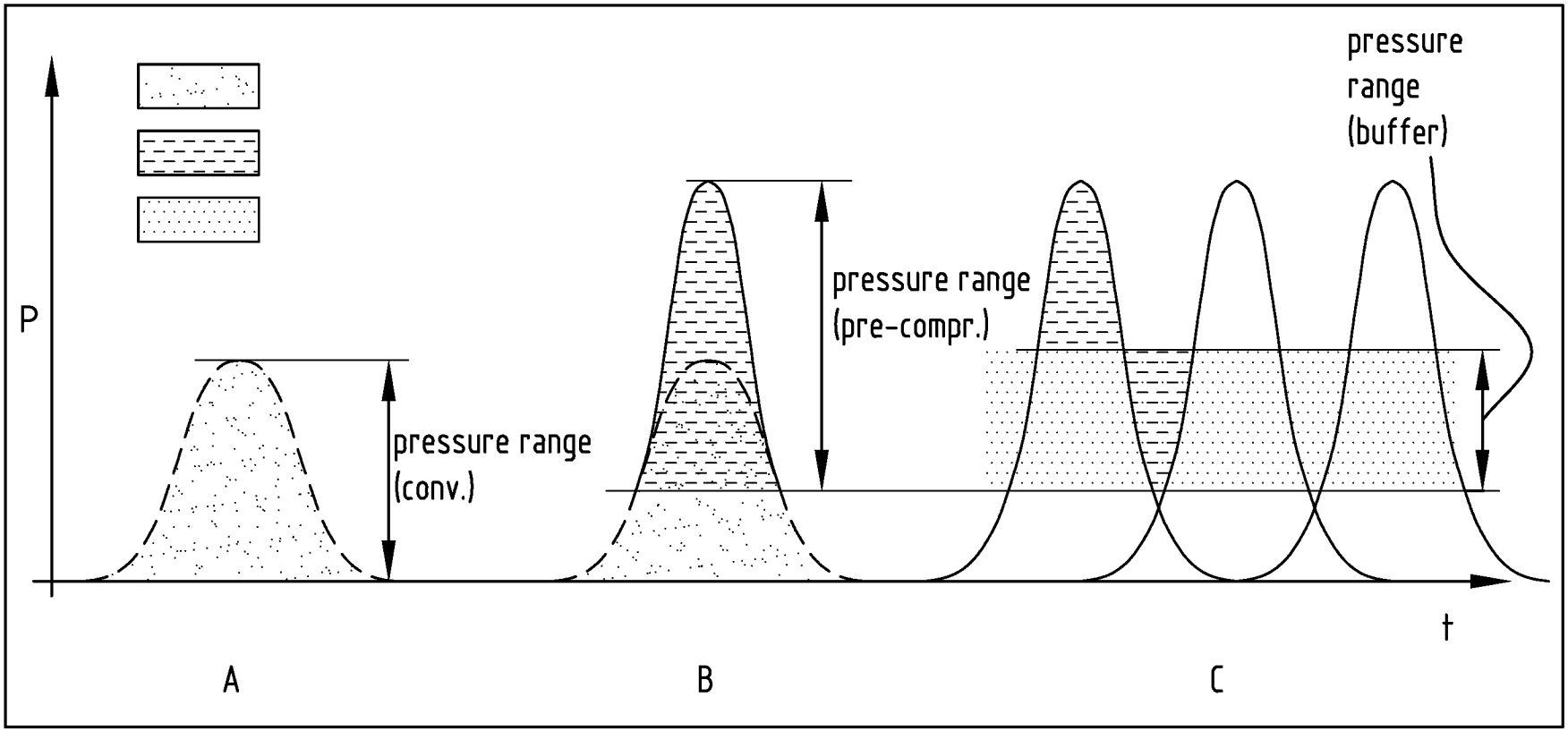
FIG. 1 shows dispensing characteristics of various types of sprayers, showing pressure as a function time.

A pre-compression sprayer has a different output curve with a different distribution of pressures and droplet sizes, as illustrated by the striped area (FIG. 1B). Notably there is a larger range of pressures that are output from a pre-compression sprayer. A pre-compression sprayer has normally closed valves. The outlet valve therefore only opens at a predetermined pressure. The displacement volume between inlet and outlet valve of the pump is to become zero during a compression stroke. If it does not, the pump cannot prime. When the piston is actuated by a user the sprayer only starts dispensing when the liquid pressure is above the cracking pressure of the outlet valve. Therefore slow actuation of the pump will give no drips because the pump starts dispensing at a higher pressure. In a pre-compression sprayer performance is less dependent upon the user's operating behavior than in the case of a conventional sprayer.

Still different than that of a standard pre-compression sprayer is the pressure time curve of a pre-compression sprayer having a buffer. A buffering pre-compression sprayer has normally closed valves just as in the case of a non-buffering pre-compression sprayer. Therefore the outlet valve only opens at a predetermined pressure. There is also a buffer, however. The buffer stores the overflow of liquid, thus preventing peak pressures as in systems with pre-compression valves, but no buffer. The synchronized components of the buffering pre-compression sprayer determine the output performance. Fast or slow triggering by a user has little effect on the output, because the pressures are equalized through buffering. The performance of a buffering pre-compression dispenser is thus very minimally dependent upon the operating behavior of the user. There is a much narrower range of output pressures because peak pressures are topped off by buffering the overflow and thus the pressures at the top of the pre-compression sprayer pressure curve are cut off at the maximum (FIG. 1C). By buffering the overflow this reduces the pressure range/droplet size spread as indicated by the regular dots. And thus for a buffering pre-compression sprayer, output pressure runs in a narrow band between the minimum pressure, that of the pre-compression valve, and the maximum pressure, which is a function of the pressure generated by the buffer during continuous strokes or during one single stroke in case of a direct stop embodiment (as described below).

Figure 2:
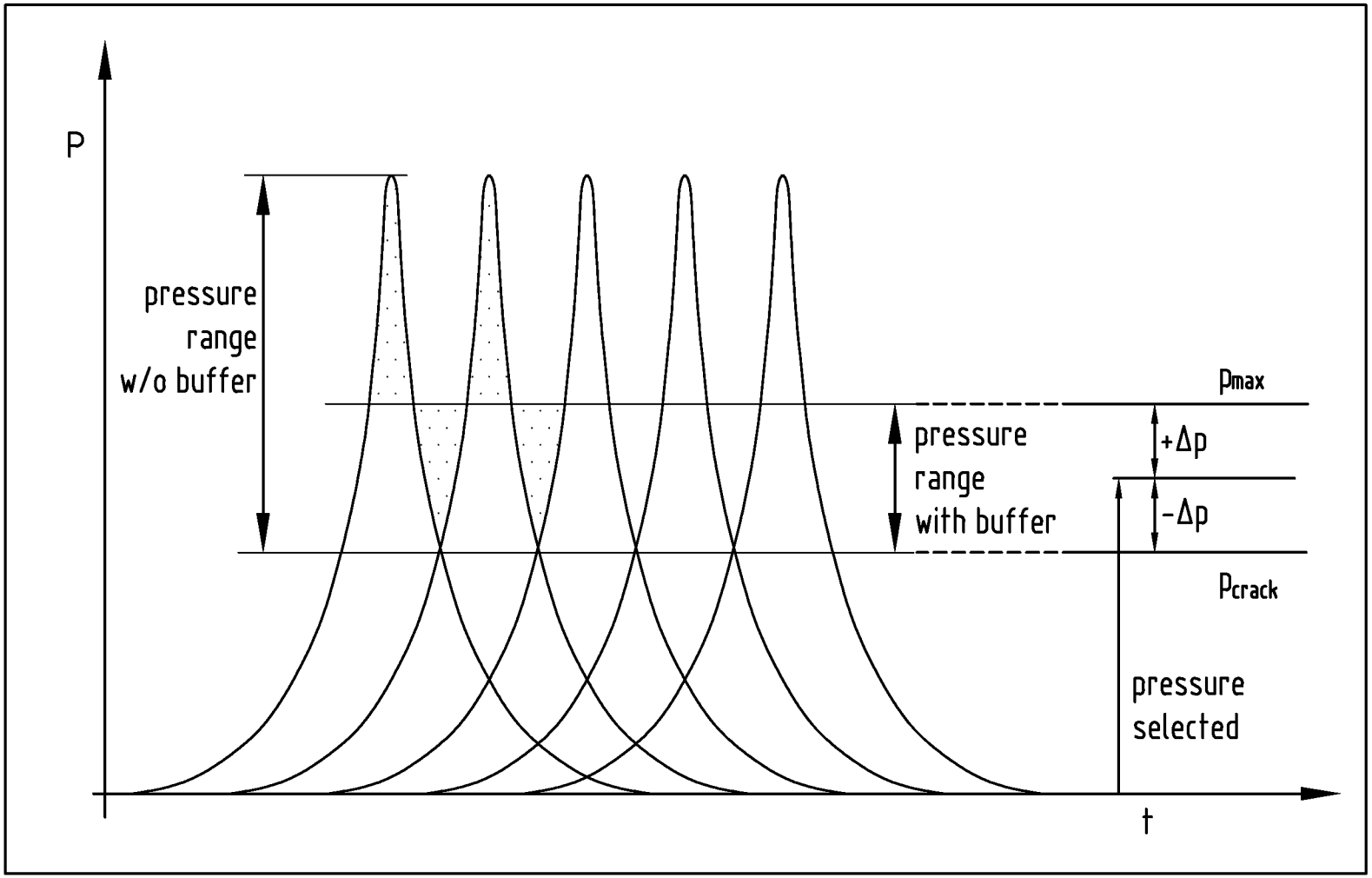
FIG. 2 shows a similar curve for a dispenser characteristic including a preferred range of pressures.

FIG. 2 illustrates further details of the correlations between elements of a buffering pre-compression sprayer. The opening pressure of the outlet, responsible for the larger droplet sizes and the maximum dispensing pressure, responsible for the smaller droplet sizes, are the controls which can be used to set the limits of the pressure range/droplet size spread. The right side of FIG. 2 illustrates a desired pressure level/droplet size which can be provided by a specification or by a user or by a customer. Given the desired pressure level/droplet size a buffering pre-compression sprayer can be created which outputs a range of pressures or droplet sizes centered on the desired pressure size and running from p minus Δp and p plus Δp. The p minus Δp is the opening or cracking pressure $p_{crack}$ of the outlet valve and the p plus Δp is the maximum dispensing pressure $p_{max}$ at a certain stroke rate.

Figure 3:
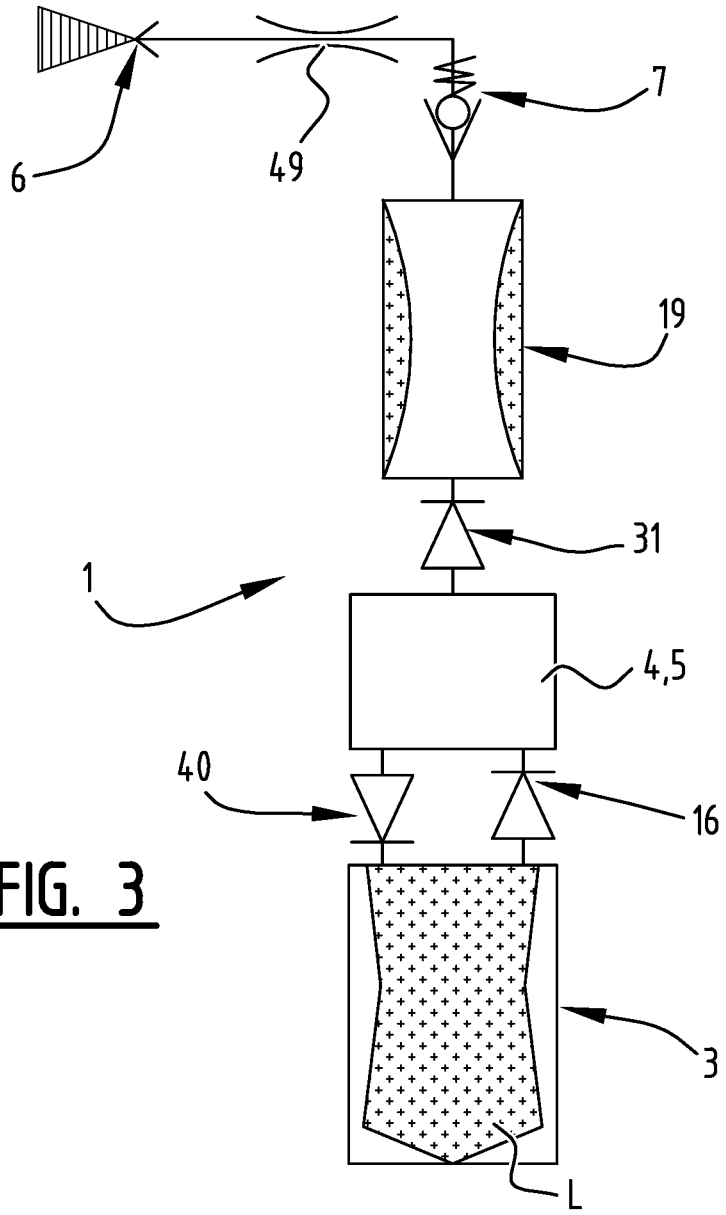
FIG. 3 is a hydraulic scheme representing a liquid dispensing device in accordance with an embodiment of the invention.
Figure 9:
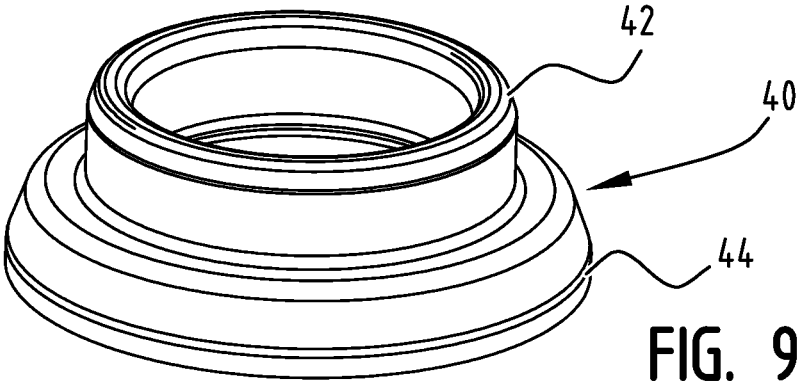
FIG. 9 is a perspective view of a prime valve as used in the liquid dispensing device of FIGS. 4-8.

FIG. 3 is a schematic hydraulic diagram of a liquid dispensing device 1 according to an exemplary embodiment of the present invention. In this schematic drawing there can be seen, beginning at the bottom of the diagram, a reservoir or container 3 that is filled with the liquid L to be dispensed. This can be a Flair® type bag-in-a-bottle or container-in-a-bottle reservoir, as described above. There is an inlet valve 16 which is a one-way valve, and which allows liquid L to enter a piston chamber 4 from the container 3 when an under-pressure is created by movement of a piston 5 in the piston chamber 4. Through the inlet valve 16 the liquid L enters the piston chamber 4 and is pushed upwards into a buffer chamber through a one-way valve 31. The liquid L flows past a buffer 19 and if there is enough pressure developed pushes open an outlet valve 7, which allows the liquid to pass through an outlet channel 49 to a nozzle 6. It is also noted that to the left of the inlet valve 16 there is shown a prime valve 40 which will be described in greater detail below.

Figure 4:
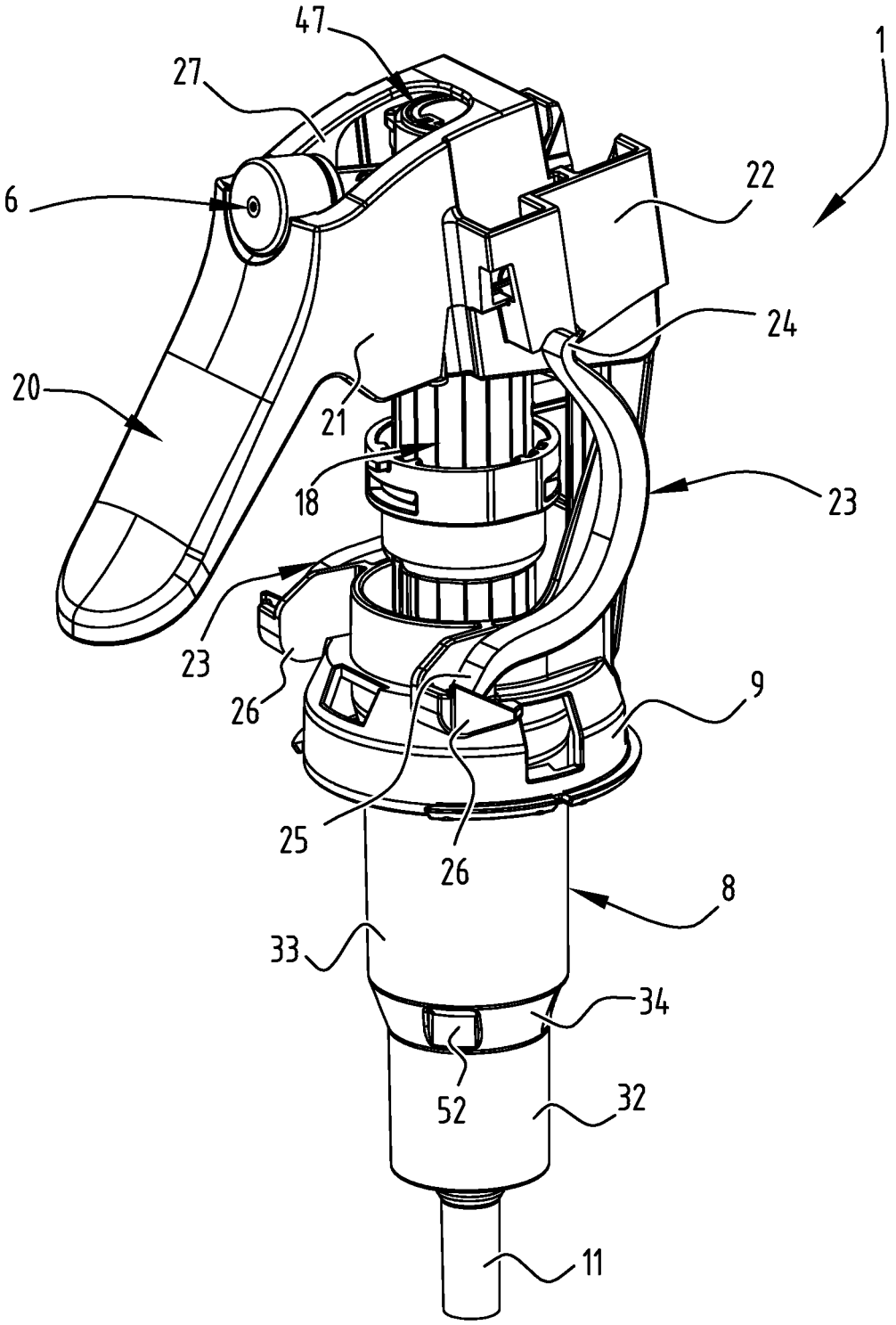
FIG. 4 is a perspective view of a physical embodiment of the liquid dispensing device of FIG. 3 without a reservoir or container.
Figure 5:
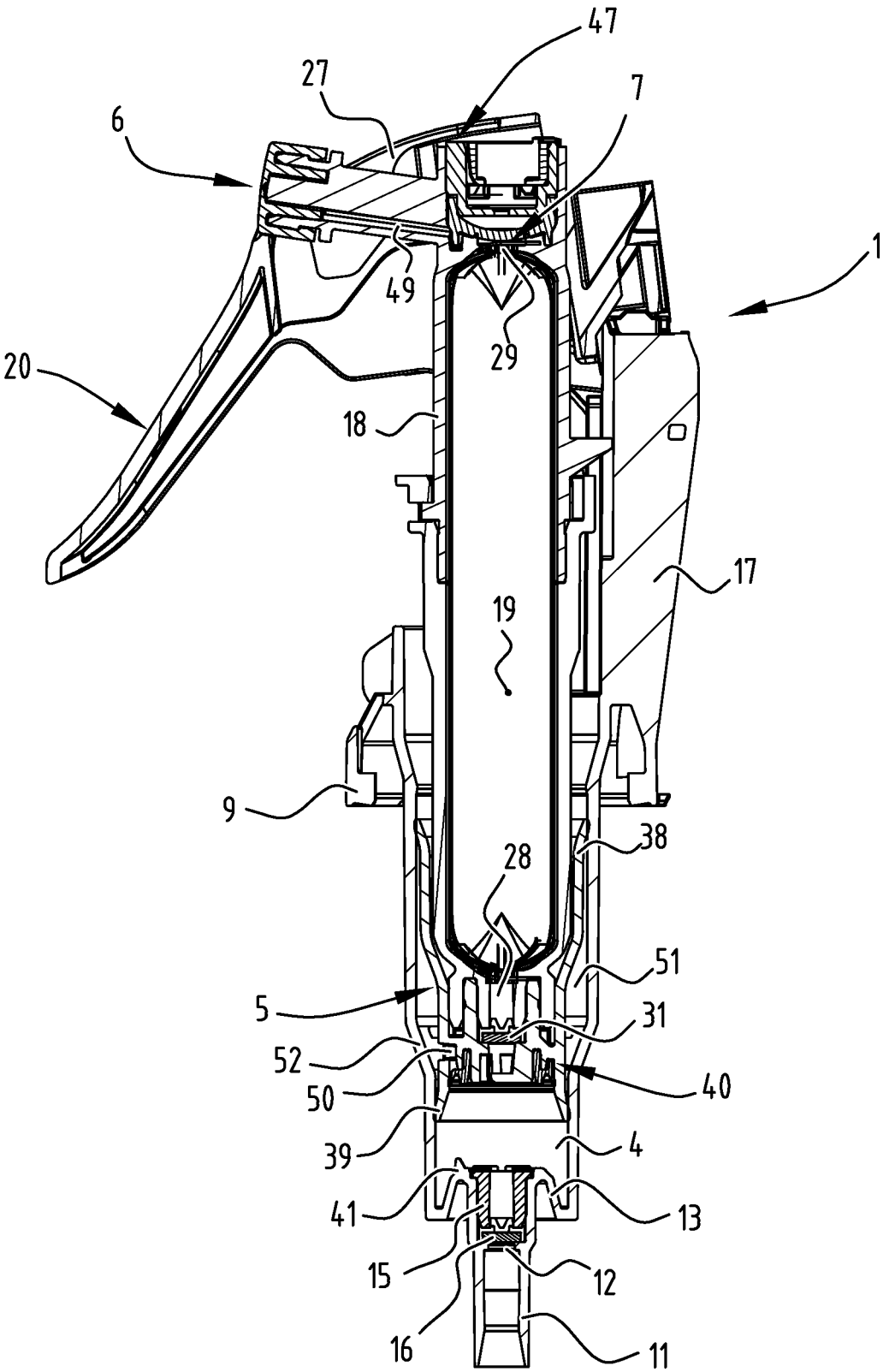
FIG. 5 is a longitudinal sectional view in the direction of the arrows V-V in FIG. 4.

FIGS. 4 and 5 depict an exemplary sprayer engine according to an exemplary embodiment of the present invention, and its various compliment parts. It is noted that the terms "sprayer engine" and "dispensing head" may be used interchangeably throughout this description to define the combination of functional elements that allow a liquid to be dispensed from a container.

Figure 13:
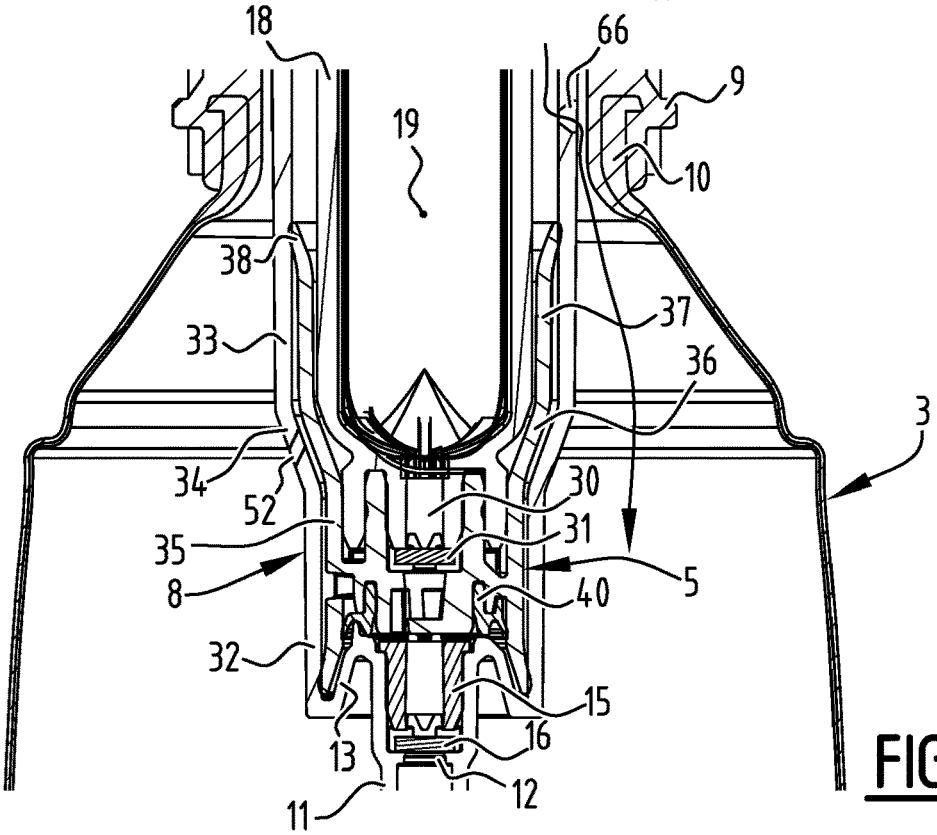
FIG. 13 is a cross-sectional detailed view corresponding to FIGS. 6 and 8, which shows the device in combination with a conventional single walled container which must be vented during dispensing.
Figure 14:
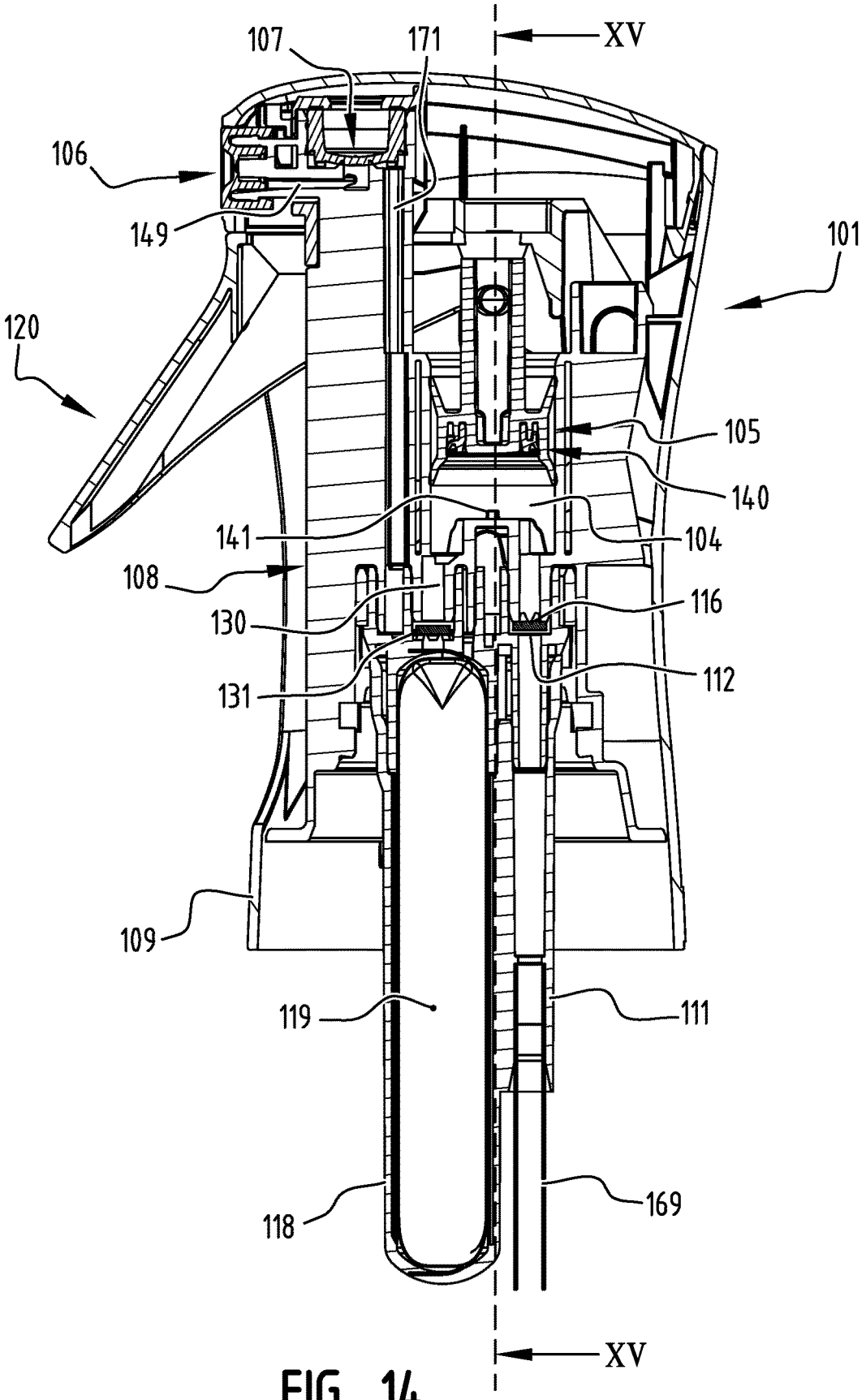
FIG. 14 shows a longitudinal sectional view of a dispensing head of an alternative embodiment of the liquid dispensing device, taken along line XIV-XIV in FIG. 15.
Figure 15:
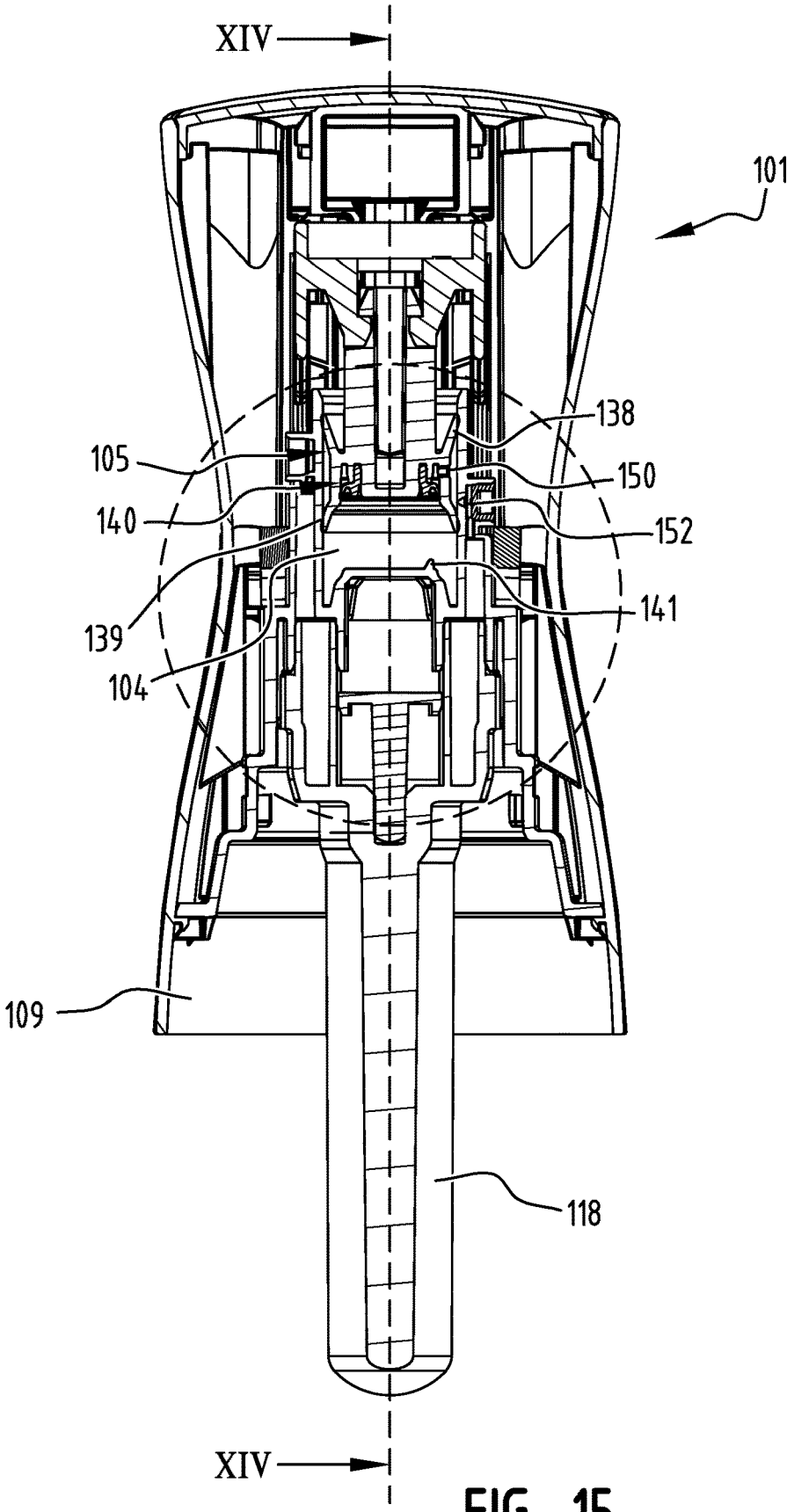
FIG. 15 shows a longitudinal sectional view of the alternative embodiment taken along the line XV-XV in FIG. 14.

The liquid dispensing device 1 as shown in FIGS. 4 and 5, which is a physical embodiment of the hydraulic scheme of FIG. 3, comprises a dispensing head 2 and a container 3 that is filled with the liquid L to be dispensed. As stated above, the container can be a Flair® type container (FIGS. 6, 8) or a conventional single wall container (FIG. 13). The dispensing head 3 includes a piston chamber 4, a piston 5 that is reciprocatingly movable within the piston chamber 4 to pressurize the liquid L to be dispensed, and a nozzle 6 with a defined throughput for dispensing the liquid L. An outlet valve 7 having a defined minimum opening pressure $p_{crack}$ is arranged between the piston chamber 4 and the nozzle 6. The piston chamber 4 is formed at a tubular lower end of a housing 8, which extends partly into the container 3. The housing 8 further includes an annular collar 9 for connecting the dispensing head 2 to a neck 10 of the container 3, e.g. by means of a snap connection or a threaded connection. At the lowermost end of the housing 8 there is a tubular protrusion 11 for receiving a dip tube (not shown) which may serve to transport the liquid L from a point near the bottom of the container 3 to the piston chamber 4. The tubular protrusion 11 is connected to an inlet opening 12 that is formed in a bottom wall 13 of the piston chamber 4. This bottom wall 13 has an upwardly curved contour surrounding a central recess 14 in which an insert 15 defining a valve seat and an inlet valve 16 are accommodated.

It should be noted that the terms "up", "upper(most)" and "top", and "down", "lower(most)" and "bottom" as used herein refer to the illustrated orientation of the liquid dispensing device 1, where the dispensing head 2 is shown to be mounted on top of the container 3 and where the nozzle is arranged at the opposite end of the dispensing head 2 from the container 3.

Extending upward from the collar 9 the housing 8 comprises a support frame 17 which serves as a backbone for supporting and guiding the moving parts of the dispensing head 2. These moving parts include a slider 18 which carries the piston 5 at its lower end and the outlet valve 7 and nozzle 6 at its upper end. In the illustrated embodiment the slider 18 is hollow and accommodates a buffer 19 which will be discussed below. The moving parts of the dispensing head 2 further include an actuator 20, in the illustrated embodiment a trigger that is pivotally supported by the support frame 17.

In this embodiment, the trigger 20 includes two side walls 21 extending on opposite sides of the slider 18, and each having an extension 22 that includes a contoured part cooperating with a pivot shaft (not shown here) on the slider 18 and that further carries a biasing member 23. In this embodiment each biasing member 23 has the form of curved flexion spring, one end 24 of which is attached to the extension 22, while the opposite free end 25 is restrained by a stop 26 protruding from the housing 8 so as to bend and preload the spring 23. Between the side walls 21 of the trigger actuator 20 an opening 27 is formed which allows the trigger actuator 20 to freely pivot without interference from the nozzle 6 or an outlet valve assembly 47.

As stated above, the slider 18 is hollow and has an inlet opening 28 at its bottom and an outlet opening 29 at its top. The inlet opening 28 communicates with a central opening 30 in the piston 5, which is closed off by a one-way valve or check valve 31. The outlet opening 29 is closed off by the outlet valve 7. In the illustrated embodiment the buffer 19 is a gas filled flexible bag, the internal pressure of which is higher than the cracking pressure of the outlet valve 7. The liquid can flow from the inlet 28 to the outlet 29 through grooves (not shown here) that are formed in the inner surface of the slider 18. Whenever the liquid pressure in the dispensing device 1 rises substantially higher than the cracking pressure, e.g. because of repeated actuation of the trigger which causes a higher liquid supply from the piston chamber 4 than the nozzle 6 can dispense, the buffer 19 will be compressed to provide space between the bag and the wall of the slider 18 to accommodate the excess liquid.

The lowermost portion 32 of the housing 8 which defines the piston chamber 4 has a diameter that is smaller than the diameter of a central portion 33 of the housing 8, which receives the slider 18. The lowermost portion 32 and the central portion 33 are connected by a tapering portion 34. The piston 5 has a similar configuration, with a lowermost portion 35 protruding from the slider 18 and having a relatively narrow diameter, a tapering transition part 36 and an uppermost portion 37 surrounding the slider 18 and having a diameter that is between the diameter of the central portion 33 of the housing 8 and the outer diameter of the slider 18. The piston 5 is provided with outwardly flaring upper and lower edges 38, 39. These outwardly flaring edges 38, 39 are sealingly slidable along the inner wall of the corresponding parts of the housing 8 so as to form upper and lower seals of the piston 5.

In accordance with an important aspect of the invention, the liquid dispensing device 1 includes a prime valve 40 that is separate from the outlet valve 7. The prime valve 40 is arranged on the piston, in this embodiment on the side of the piston 5 facing the bottom wall 13 of the piston chamber 4. The prime valve 40 is mechanically operable, i.e. its operation is independent of the pressure of the air that is present in the device 1. In the illustrated embodiment the prime valve 40 is operable by an operating member 41 which is arranged in the piston chamber 4. The operating member 41 may be a protrusion that is arranged on the bottom wall 13 of the piston chamber 4. In this embodiment the prime valve 40 is normally biased to a closed position, so that closing of the prime valve 40 does not require action from the operating member 41. Prime valve 40 will open when engaged by the operating member 41 and will automatically close as soon as the engagement ends.

Figure 10:
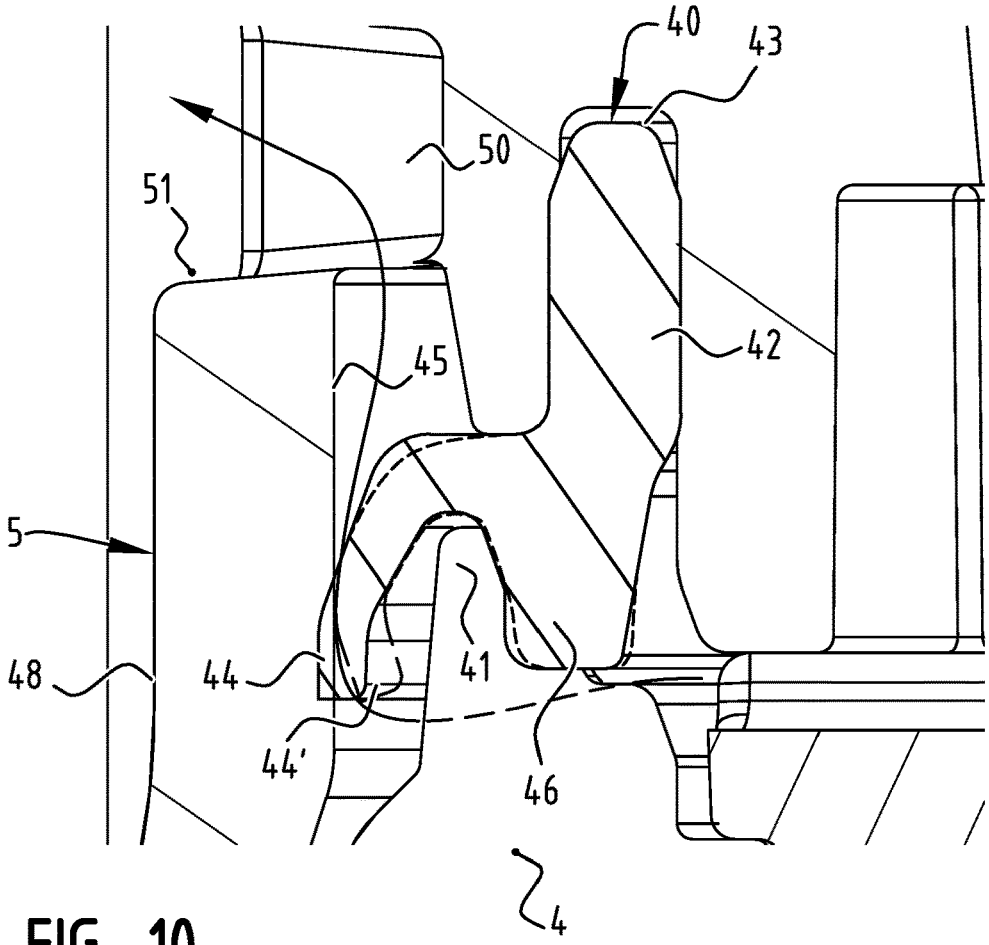
FIG. 10 is a detailed view on enlarged scale showing the deformation of the prime valve during priming.

In the illustrated embodiment the prime valve 40 is resiliently deformable and opens when it is deformed by the operating member 41. The prime valve 40 is formed by an annular member that has a central part 42 which snugly fits in an annular groove 43 in the bottom of the piston 5. The prime valve 40 has an outer peripheral edge 44 which is relatively flexible and which seals against an inner surface 45 of an outer peripheral wall 48 of the piston 5. This flexible sealing part 44 is resiliently deformable when the operating member 41 engages the prime valve 40. Due to its resilience, the sealing part 44 returns to its original position as soon as the engagement with the operating member 41 ends. It should be noted that the operating member 41 does not directly engage the sealing part 44, in order to avoid damage to this sealing part 44, which might lead to leakage. Instead the operating member 41 engages an actuating part 46 of the prime valve 40 (FIG. 10). This actuating part 46 is formed by an annular rim that is arranged radially inwards from the outer sealing edge 44.

In one embodiment (FIGS. 6-10) the actuating part 46 and the sealing part 44 have substantially opposite orientations. Whereas the actuating part 46 is upwardly inclined for smooth engagement with the operating member 41, which upwardly protrudes from the end wall 13, the sealing part 44 is inclined downwardly, more or less parallel with the outwardly flared lower edge 39 of the piston 5. In this way the sealing part 44 is always biased to a closed position by the pressure in the piston chamber 5. This arrangement prevents leakage of both air and liquid under any circumstances.

Figure 12:
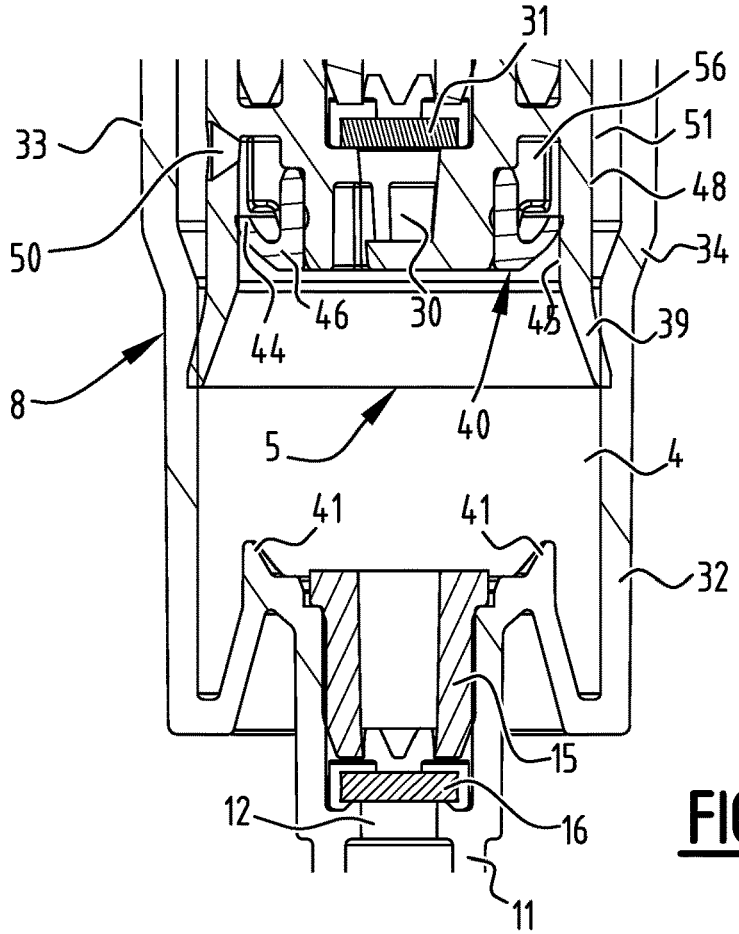
FIG. 12 is a cross-sectional detailed view of a piston carrying an alternative embodiment of the prime valve and a piston chamber having alternative operating members.

Alternatively, the sealing part 44 and the actuating part 46 may be substantially parallel or even in line with each other (FIG. 12). Here again the actuating part 46 is upwardly inclined, and so is the sealing part 44. In this way the sealing part 44 may be urged away from the inner wall 45 of the piston 5 when the pressure in the piston chamber 4 exceeds a predetermined level. Thus, the prime valve 40 also functions as an overpressure relief valve. Obviously, the flexibility of the sealing part 44 should be selected such, that the prime valve 40 will remain closed during normal operation of the liquid dispensing device 1, to prevent leakage of liquid through the prime valve 40 which would affect the operation of the device 1. Only when a potentially critical pressure is reached within the piston chamber 4 should the sealing part 44 of the prime valve 40 yield and allow liquid to escape. In this embodiment there are two operating members 41 which are arranged on opposite sides of the inlet opening 12. Moreover, these operating members have a slightly different geometry than the single operating member 41 of the other embodiment.

The prime valve 40 closes off an orifice 50 that is formed in the piston 5. This orifice 50 opens onto the peripheral sidewall 48 of the piston 5, so as to form a flow path for the air between the piston chamber and a space 51 between the piston 5 and the housing 8, which is bordered by the upper and lower seals 38, 39. An opening 52 is formed in the housing 8 and is in direct communication with the head space 53 above the liquid L in the container 3.

Figure 11:
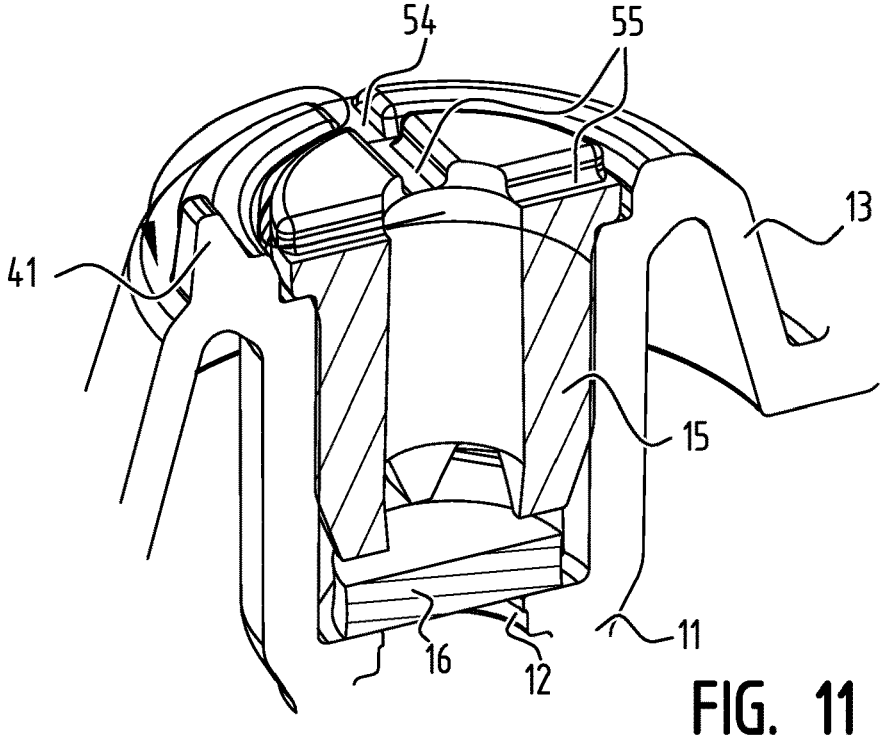
FIG. 11 is a cross-sectional perspective detailed view on enlarged scale of the bottom of the piston chamber and the inlet valve.

In order to allow all remaining air to reach the orifice 50 in the piston 5 when the piston is at or near the end of its stroke, grooves or recesses 54, 55 may be formed in the bottom wall 13 of the piston chamber 4 and/or in the insert 15 defining the valve seat (FIG. 11). Through these grooves 54, 55 air can flow towards the operating member 41 and from there along the deformed seal part 44 of the prime valve 40 to the orifice 50 in the piston 5.

In the alternate embodiment of the prime valve the orifice 50 in the piston 5 is connected to an annular space 56 which is defined by the central part 42 of the prime valve 40 and the inner surface 45 of the piston wall 48. This annular space 56 has a relatively large volume and allows fluid to be evacuated from the piston chamber 4 relatively quickly when the pressure in the piston chamber 4 exceeds the predetermined value and the prime valve 40 has to serve as overpressure relief valve. It is further to be noted that in this embodiment, where there are two operating members 41 on opposite sides of the piston chamber 4, there is no need to lead air all across the bottom of the piston chamber 4, so that this embodiment lacks the grooves 54, 55 in the insert 15 and the bottom 13 that are a characteristic of the other embodiment.

Figure 6:
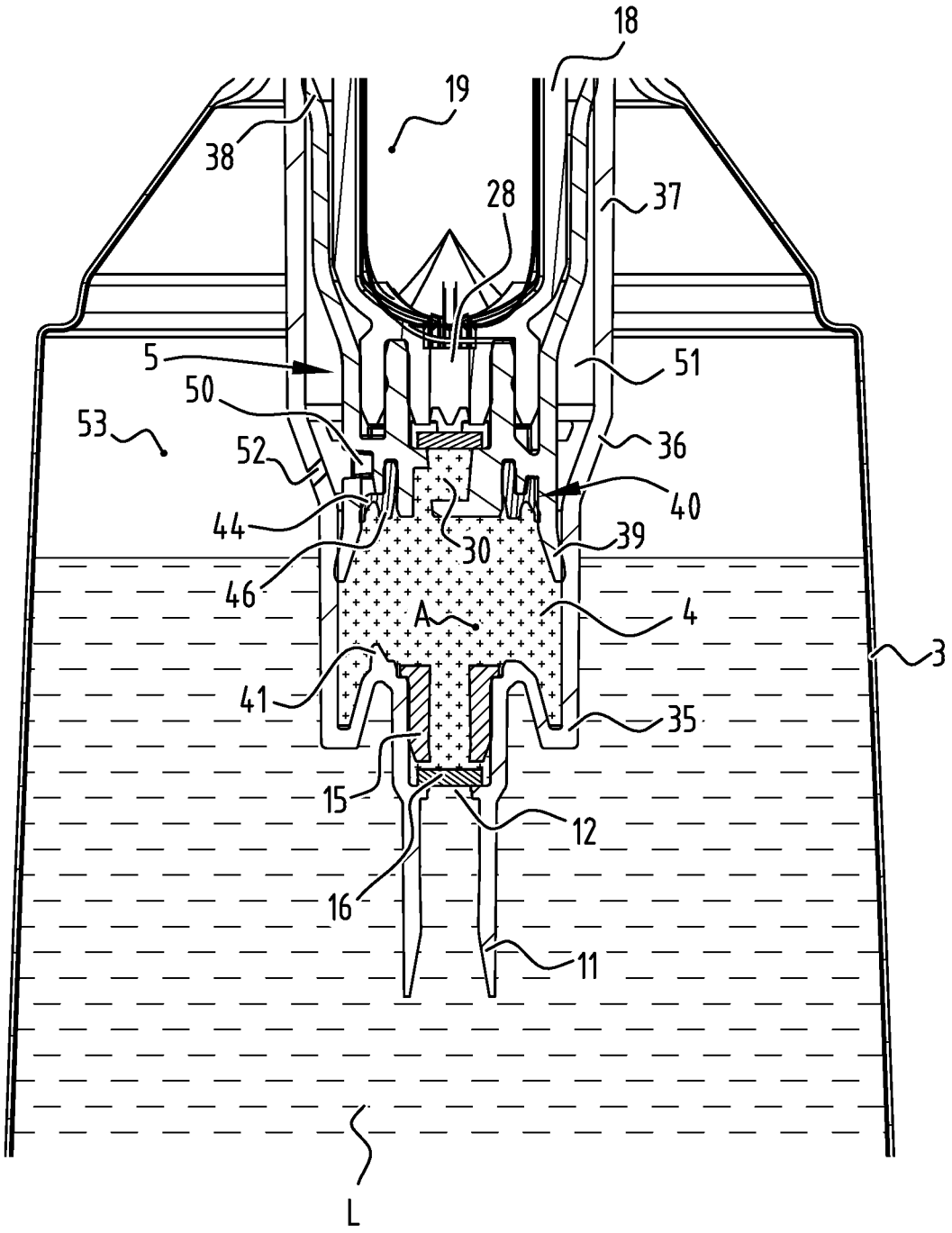
FIG. 6 is a longitudinal section of the lower part of the device of FIG. 5 and the container with the liquid to be dispensed, in which the device is shown in its initial state, before priming.

To understand what the prime valve 40 does, reference is made to FIGS. 5,6, where an upstroke of the piston chamber is initially filled with air. This can be the air which entered the piston chamber 4 during manufacturing, for example.

In order to be able to operate the device 1 and dispense liquid, it is necessary to first remove this air. Therefore, with reference to FIGS. 7, 8, in the initial down stroke, the trigger 20 is pulled and the piston 5 moves downwards which compresses the air A in the piston chamber 4. It is here noted that in conventional sprayers, even some that utilize pre-compression valves, the cracking pressure for the outlet valve is generally relatively low. Therefore, in such conventional sprayers it is relatively easy to prime the sprayer by developing a pressure inside the sprayer engine with just air. When that air is sufficiently pressurized to overcome the cracking pressure of the outlet valve, which is not that high, it can exit the sprayer through the nozzle.

These conventional sprayers have approximately a cracking pressure of 1.5 bar or less on their pre-compression or outlet valve, and thus opening the valve with compressed air is generally not an issue. However, as described in WO 2014/074654 A1 referenced above, in order to granularly and precisely control the band of output pressure in which liquid droplets or foam particles exit a buffering pre-compression sprayer, it is advantageous to use dome valves, or outlet valves, having a much higher opening pressure, such as, for example, from 2.5 to 4, or even 5 or more bar. With such a high opening pressure, it is difficult to evacuate all the air and thereby prime the sprayer—especially in circumstances where there are many internal channels and spaces which are simply not compressible. It should be noted that this issue rises regardless of the presence of a buffer; it is purely due to the high cracking pressure of the pre-compression outlet valve.

Of course, it is possible to compress the piston chamber volume by pressing the piston 5 downward. However, it is not possible to compress the various other internal channels and tubes that may exist in a buffering or non-buffering pre-compression sprayer. For that reason it is desirable, or optimal, in order to ensure that as much air can be evacuated as possible from the sprayer, to have a separate priming valve system. This is next described.

Figure 7:
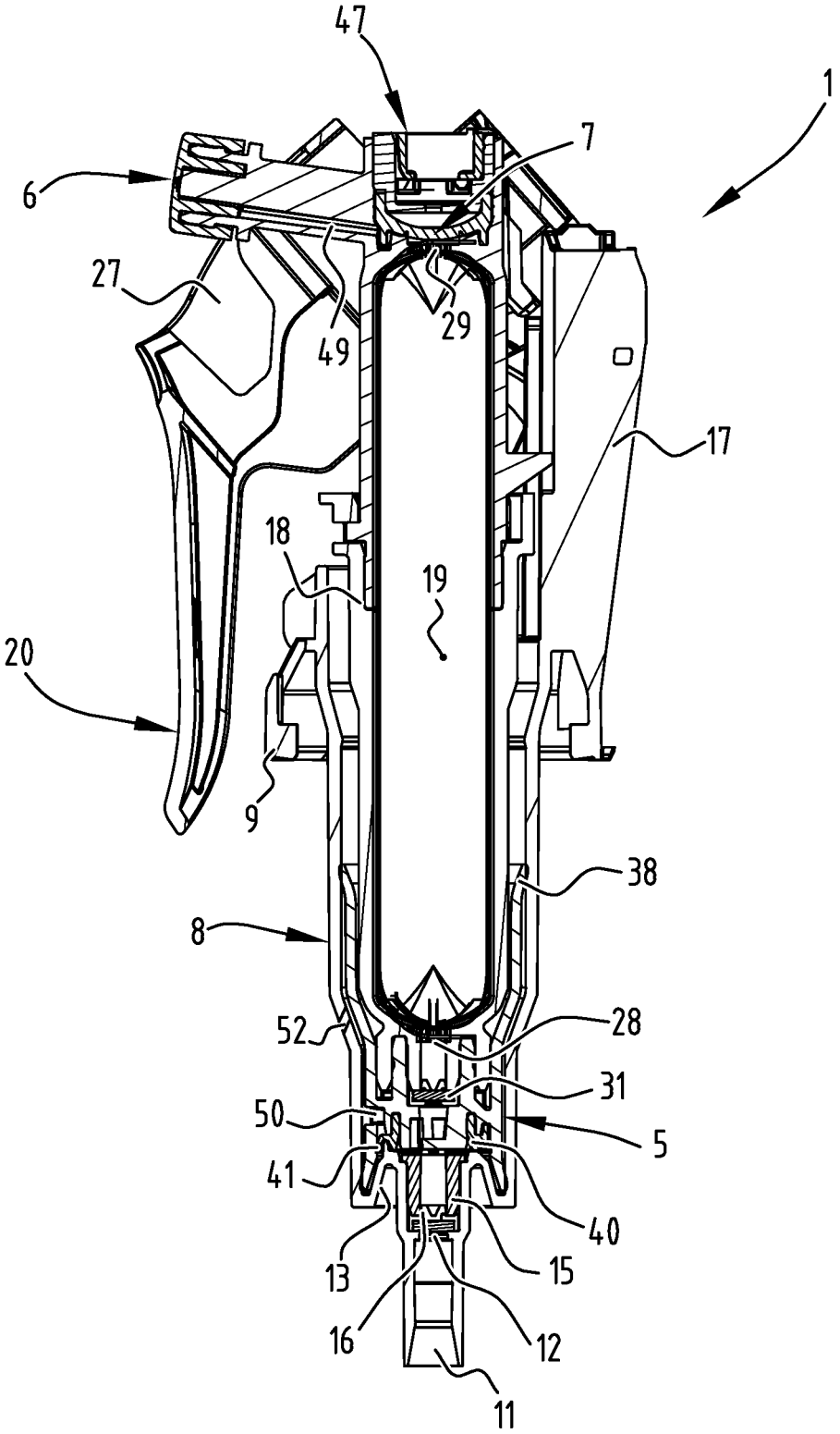
FIG. 7 is a longitudinal sectional view corresponding with FIG. 5, but showing the device at the end of a pump stroke, with its trigger actuator depressed and its piston in the lowermost position.
Figure 8:
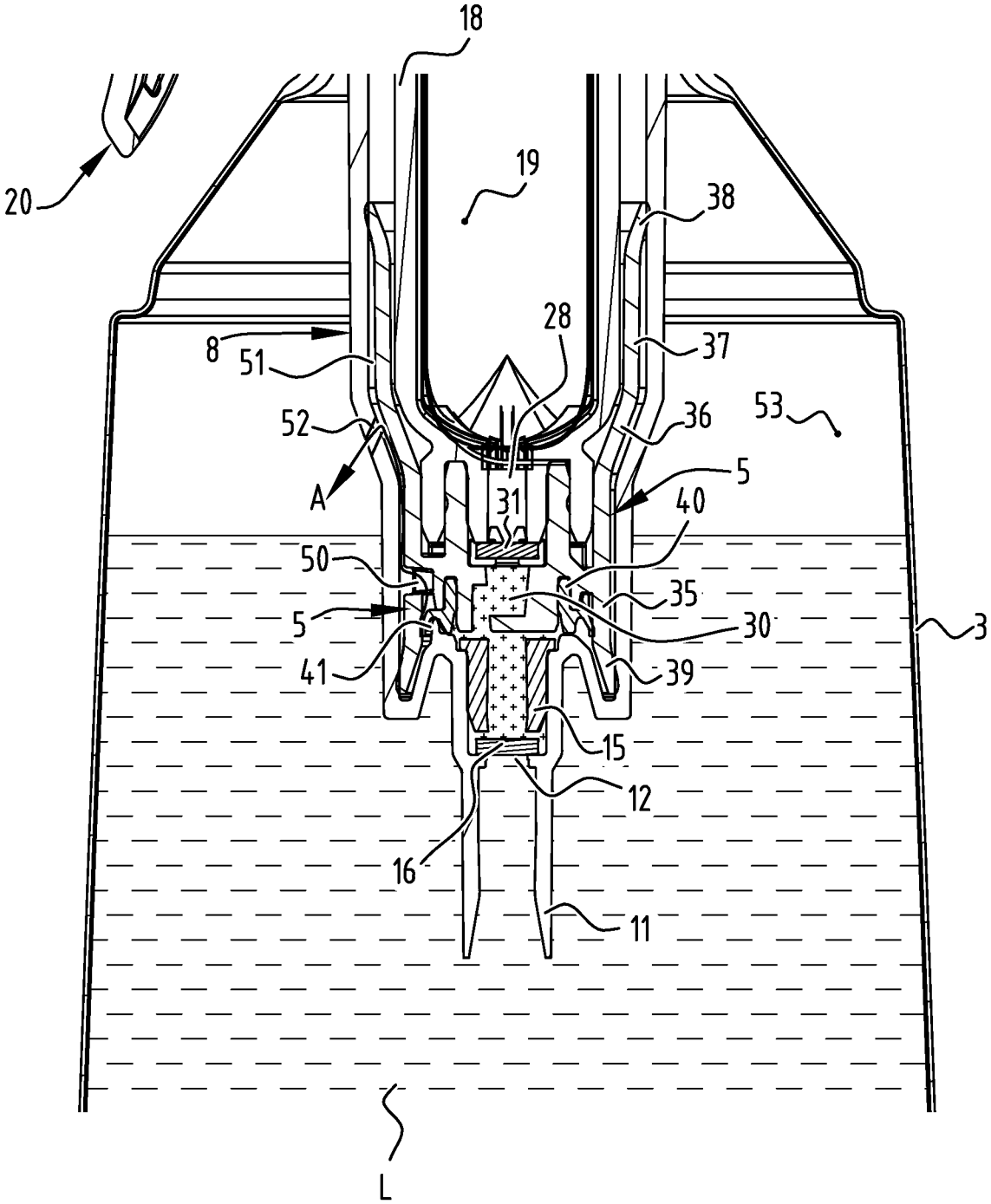
FIG. 8 is a view corresponding with FIG. 6 but showing the piston in its lowermost position during priming, when still some of the air has to escape.

With reference to FIG. 7, as the trigger 20 is pulled and the piston 5 moves downward, the air is compressed at the bottom 13 of the piston chamber 4, as shown. When the piston 5 goes all the way down, the actuating part 46 of the priming valve 40 that is provided on the bottom of the piston 5 engages with the operating member 41, which protrudes from the bottom 13 of the piston chamber 4. That causes a push to be exerted by the operating member 41 from the housing 8 onto the inner side of the annular rim 46 at the bottom of the prime valve 40 as shown in FIG. 8 and in FIG. 10 in magnified detail. That push or displacement of the actuating part 46 causes the outer edge region forming the sealing part 44 of the prime valve 40 to move inwards, thus allowing air to escape around its side, out the orifice 50 in the piston 5. This air then flows through the space surrounding the piston 5 and bordered by the upper and lower seals 38, 38, and finally out through the opening 52 in the housing 8, back to the head space 53 above the liquid L in the container 3.

In the alternative embodiment that is illustrated in FIG. 12, when the piston 5 carrying the prime valve 40 is pushed all the way down so as to engage the operating member 41, this causes the outer edge portion of the prime valve 40, which forms both the actuating part 46 and (further outward) the sealing part 44, to be displaced slightly inwards (towards its center point) In this way air is allowed to escape around the sealing part 44 into the annular space 56 of the piston 5. From there the escaped air may flow through the orifice 50, the space 51 surrounding the piston 5 and the opening 52 in the housing 8. In this way the air may enter back into the reservoir and form part of the head space 53 in the reservoir 3.

As mentioned above, when the container 3 is a Flair® type container, venting of the interior of the container 3 when liquid is being dispensed is not necessary. However, the dispensing head or sprayer engine 2 of the invention can also be used in combination with conventional single walled containers. In that case, whenever liquid L is dispensed from the container 3, a similar volume of air has to be introduced into the container to prevent the formation of under-pressure. To that end a venting opening 66 may be formed in the housing 8 (FIG. 13). This venting opening 66 should be arranged higher in the housing than the return opening 52 for the priming function, since the venting opening 66 must be exposed when the piston 5 is at the end of its stroke, in its lowermost position in the piston chamber 4. During an upward movement or inlet stroke of the piston 5 the upper seal 38 of the piston 5 passes the venting opening 66, which then becomes isolated from the ambient atmosphere because it is surrounded by the upper and lower seals 38, 39. During the downward or pressurizing stroke of the piston 5, the venting opening 66 becomes exposed again as soon as the upper seal 38 passes, and air may be drawn into the container 3 to compensate for the liquid that has been withdrawn.

As stated above the outlet valve 7 is a pre-compression valve. In the illustrated embodiment the pre-compression outlet valve 7 is a dome valve. This dome valve 7 comprises a sleeve 57 which surrounds the actual dome 58. The sleeve 57 is accommodated in a bore 59 at the top of the housing 8. The dome valve 7 is supported by a support member 60, which has substantially the same configuration as the valve 7, and which serves to prevent the dome 58 from being forced into a "reversed" state from which it cannot recover. A small space 61 is kept between the dome 58 of the valve 7 and a similarly dome-shaped part 62 of the support member 60. In order to prevent air in that space 61 from becoming trapped and affecting movement of the dome 58, a vent opening 63 is provided. A cover 64 is snapped into the support member 60 to prevent contact between the interior of the device 1 and the surrounding atmosphere. The dome 58 seals against an annular valve seat 65, which surrounds the outlet opening 29 at the top of the slider 18. The outlet valve 7, the support member 60 and the cap 64 constitute the outlet valve assembly 47.

Figure 19:
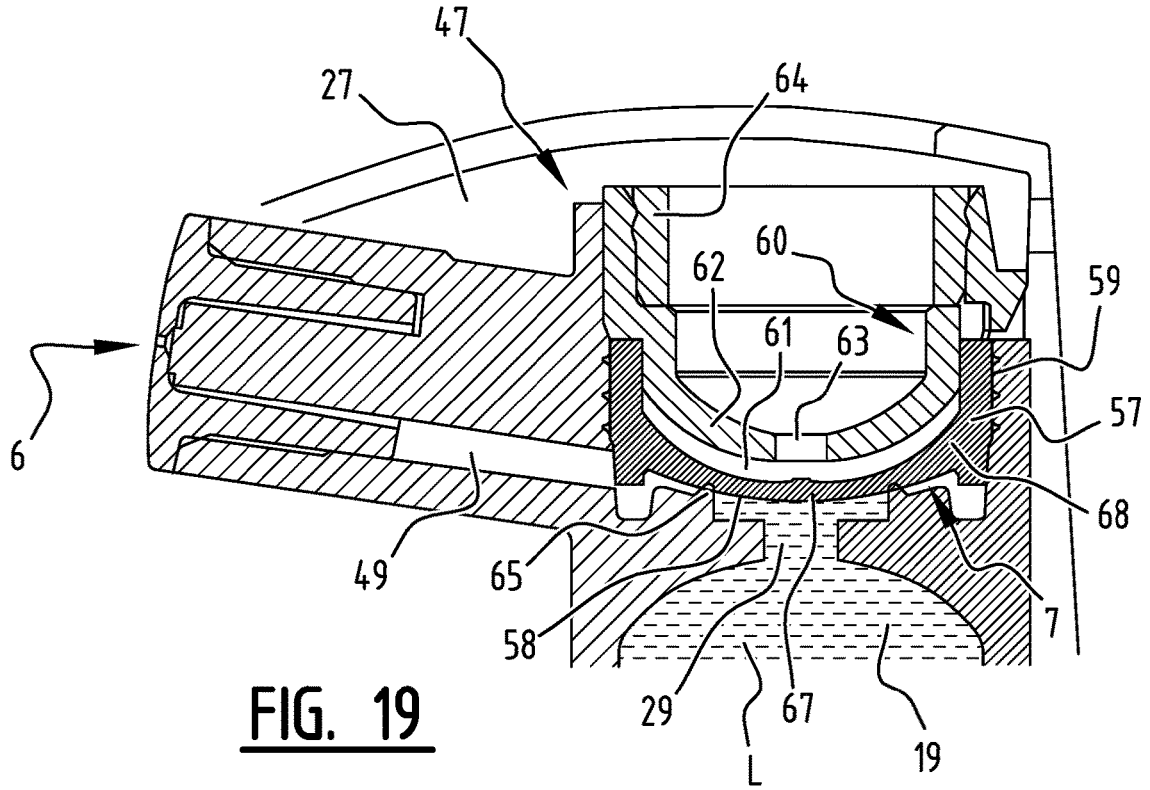
FIG. 19 is a detailed view of the top of the dispensing device as shown in FIGS. 5 and 7, with the outlet valve being closed.
Figure 20:
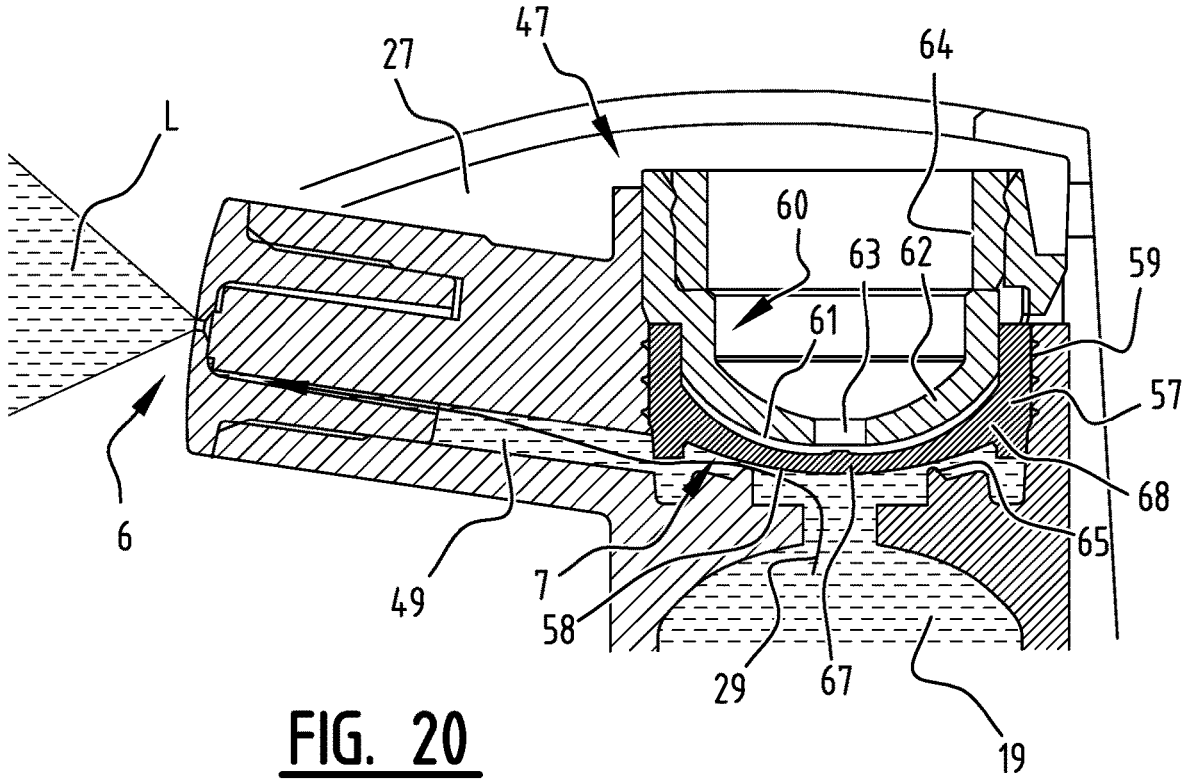
FIG. 20 is a view corresponding with FIG. 19 but showing the outlet valve opened and liquid being dispensed.

As indicated above, it is desirable to provide a dome valve that has a more binary behavior than conventional domes. This is achieved by a more instantaneous opening and closing of the dome with as little as possible difference in the opening and closing pressure of the dome. As shown in FIG. 19, when the dome outlet valve 7 is in the closed position, the bottom of the dome 58 is sealed against the valve seat 65. Therefore, any liquid in the buffer cannot pass through the closed pre-compression valve because the pressure of the liquid is not high enough, i.e. $p_{liquid}<p_{crack}$. At higher liquid pressure, as shown in FIG. 20, the outlet valve 7 opens. The minimum opening pressure, known as the cracking pressure or opening pressure, being exceeded, liquid can pass through an opening created between the bottom surface of the dome 58 and the valve seat 65, as shown by the arrow in FIG. 20.

It has been found that there is a correlation between the diameter $D_{seat}$ of the valve seat 65, the dome valve diameter $D_{dome}$, and the hysteresis which, in this context, means the difference between the opening pressure and the closing pressure of the dome valve. Obviously, the dome valve diameter $D_{dome}$ must be equal to or larger than the valve seat diameter $D_{seat}$ to ensure proper sealing. The difference in diameters increases the hysteresis, thus making the opening pressure higher than the closing pressure of the dome valve. This is not necessarily desirable in many contexts and therefore it is desired to make the difference in diameters as small as possible without impacting sealing.

As shown in FIG. 19, the dome 58 of the valve 7 is stressed as it sits on the valve seat 65 and therefore to open it requires even more tension to be applied, because in the open state of FIG. 20 it is even further from its natural resting state. In other words, he dome 58 of outlet valve 7 is already prestressed away from its natural resting state, or full flexion, in the closed position as shown in FIG. 19. This is due to the presence of the valve seat 65.

Continuing with reference to FIG. 19, it can be easily seen that there is a kind of central ring, almost a flat circle, but not quite, at the center of the dome 58 of valve 7 which is the thinnest portion of the entire outlet valve 7. As can be readily seen, when one moves away from the center towards the sleeve 57, or vertical structural support of the dome valve, the dome valve thickness, i.e. membrane thickness, gets larger. This allows only the central circular portion 67 (actually a circular portion of a spherical surface) to flex up and down to open and close the dome valve, while the thicker portions 68—those essentially not above the seal—do not move much, if at all. In fact, when the dome valve 7 opens the potential energy or the tension is stored in those thicker portions 68, which comprise the outer ring of the dome valve 7, closest to the vertical sleeve 57.

In exemplary embodiments of the present invention, there are various ways to vary the membrane thickness starting from the center and varying along the radius. The goal is to minimize the hysteresis and implement a more binary quick opening and closing of the dome valve so as to prevent any kind of dripping once a user stops spraying, for those sprayers which have a direct action capability. This minimization of hysteresis is, in general, material specific. In other words, each different material will have an optimal range of minimum thicknesses for the portion 67 of the dome valve 7 that will flex as it is opened, and a maximum thickness for the outer ring 68 that does not flex.

Figure 22:
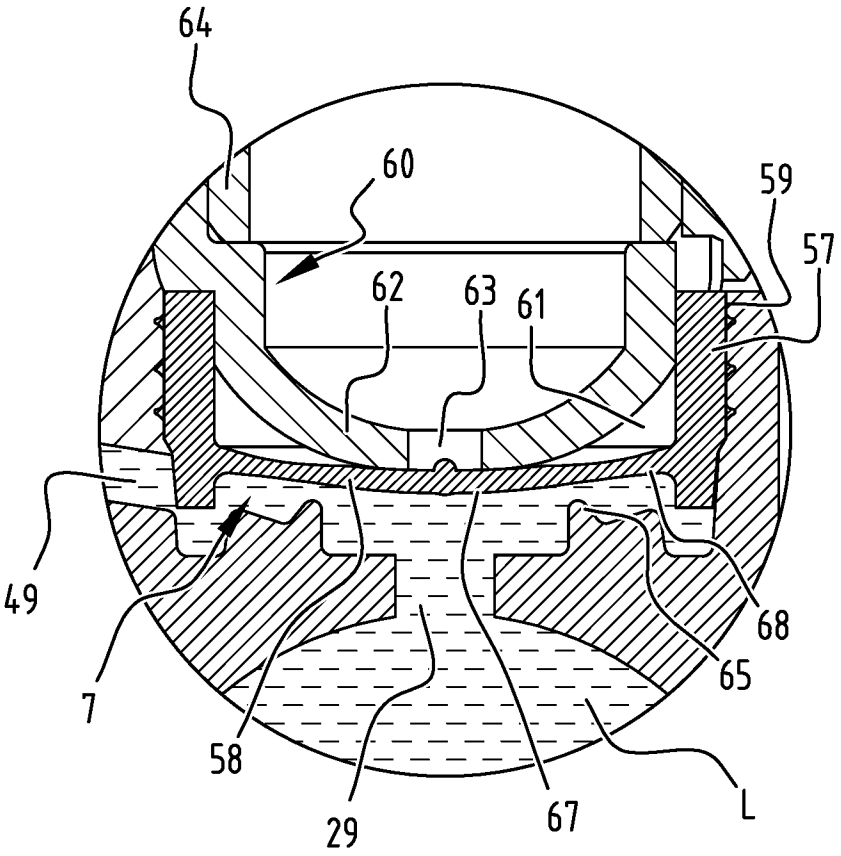
FIG. 22 is a view corresponding with FIG. 21 but showing the valve in open position.
Figure 21:
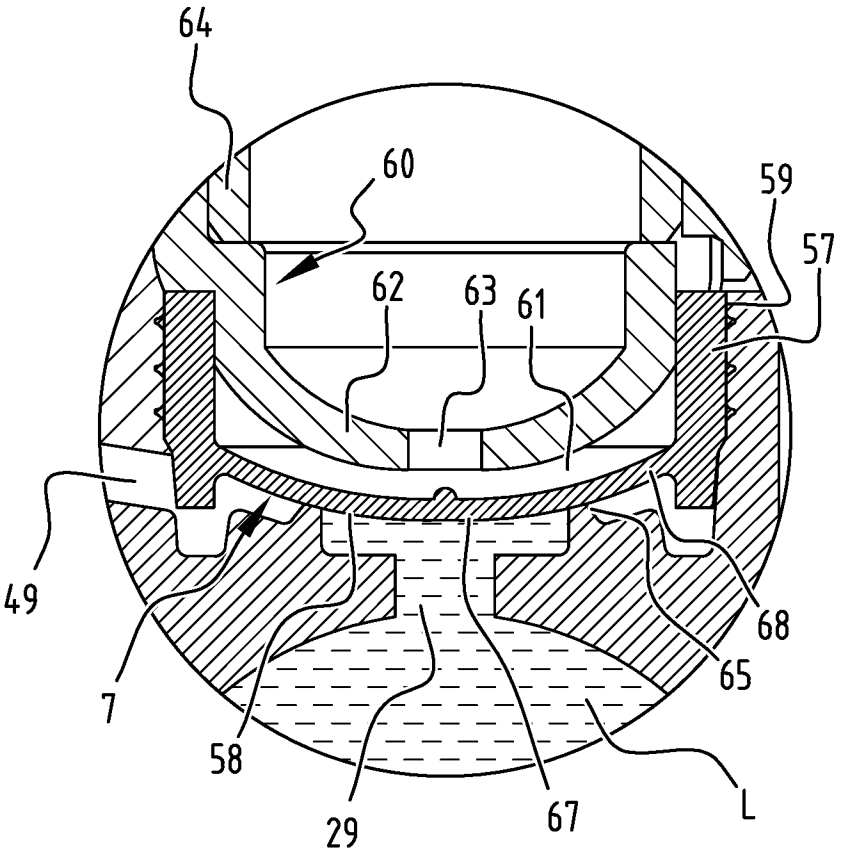
FIG. 21 is a detailed view of an alternative embodiment of the outlet valve of FIG. 19 in closed position.
Figure 24:
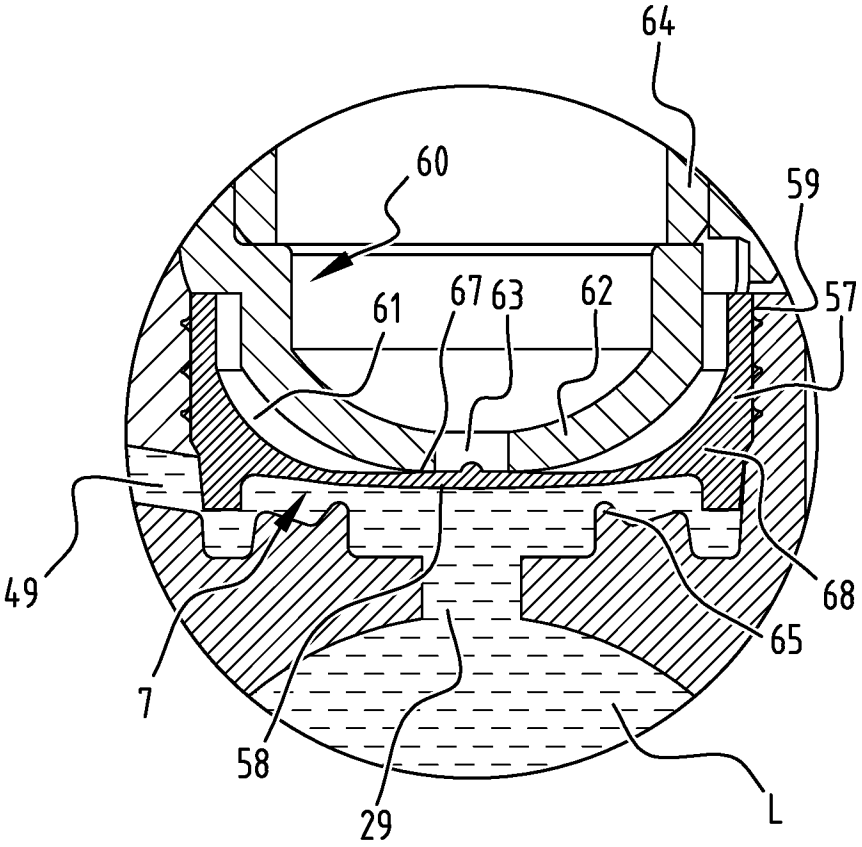
FIGS. 23 and 24 are views which correspond with FIGS. 21 and 22 but show yet another embodiment of the outlet valve.
Figure 23:
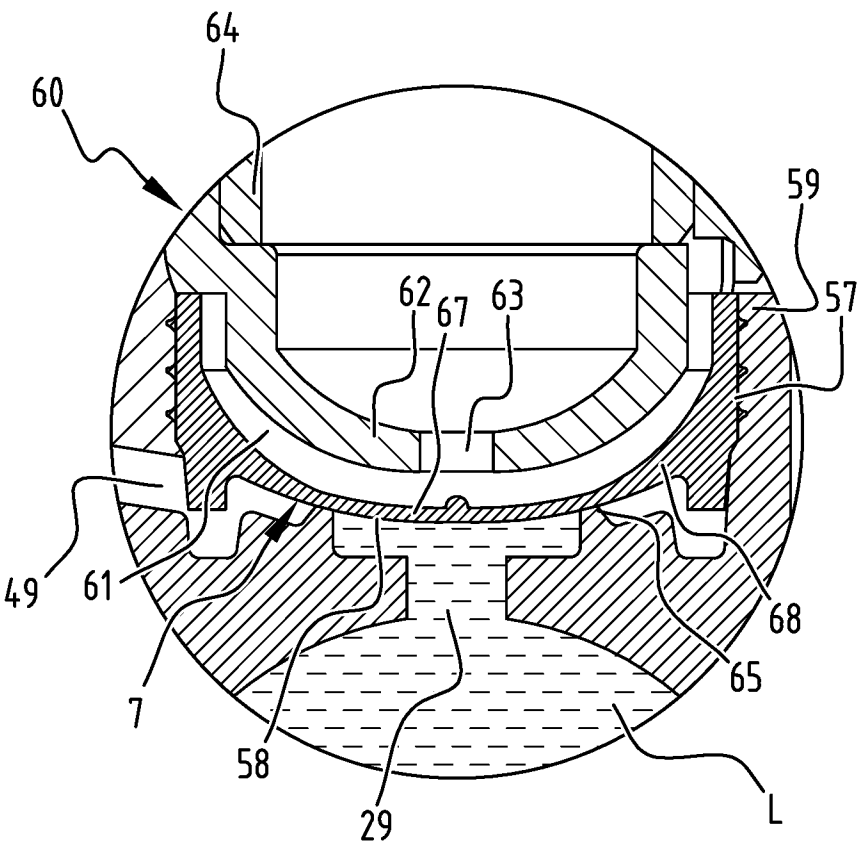

Thus, with an eye towards such variations, FIGS. 21-24 show various exemplary thickness profiles of the dome valve center 67 and the dome valve edges 68. FIGS. 22 and 24 show the dome valve 7 as opened, and FIGS. 21 and 23 show it as closed, fully seated on the seat 65. FIGS. 21 and 22 show a thinner dome than FIGS. 19 and 20, which therefore varies less as it reaches the sleeve 57, although it does vary somewhat and does get thicker there. FIGS. 23 and 24, on the other hand, show kind of the opposite concept to FIGS. 21 and 22. In FIGS. 23 and 24 the dome valve 7 is very thin at the center 67 and then gets progressively thicker as you move away from the center. There is a marked change in thickness from the center to a radius that reaches near the outer boundary of the valve seat 65. The membrane gets thicker and thicker from that outer ring point to the sleeve 57, as can be seen in FIGS. 23 and 24, where near the sleeve 57 the membrane is very thick.

Which of these exemplary configurations is used depends on the type of material that one desires to craft the dome valve in. The thickness profile and diameter, and the difference in diameter between the dome valve and that of the valve seat 65 ($D_{dome}$–$D_{seat}$ as described above in connection with FIG. 19) is in general material specific. Depending upon the material desired to be used for the valve, such as, for example polypropylene, polyethylene, polyamide, and POM, an appropriate thickness and diameter difference will be needed in various exemplary embodiments of the present invention. The goal of all of this is, as noted, and as shown in FIGS. 19-24, to create a dome valve having a more binary behavior and therefore having a more instantaneous opening and closing, with little as possible difference in the opening and closing pressures.

FIGS. 14-18 show an alternative embodiment of the liquid dispensing device 101 of the present invention. In this alternative device 101 the buffer 119 is not arranged in a slider, but is rather fixed to the housing 108. The buffer 119 is arranged in a frame part 118 that is attached to the housing 108 at its bottom. The frame part 118 includes a tubular part 111 for receiving the dip tube 169, which tubular part 111 also defines an inlet channel 170 leading to the inlet opening 112 below the piston chamber 104. The inlet opening 112 is again closed off by an inlet valve 116. The piston 105 is reciprocatingly movable in the piston chamber 104 by an actuating mechanism that includes a trigger 120. This actuating mechanism is described in detail in the applicant's earlier application WO 2011/139383 A1. In this embodiment the buffer 119 is not arranged in-line between the piston chamber 104 and the outlet valve 107. Therefore, there is no need for the liquid to be dispensed to flow through the piston 105. Instead, the piston 105 forces liquid through an outlet channel 130, which communicates with the buffer 119 and which is closed off by a check valve 131. From the buffer 119 a further outlet channel 171 runs alongside the piston chamber 104 towards the outlet valve 107. After passing the outlet valve 107, the liquid flows through a channel 149 to the nozzle 106.

Figure 16:
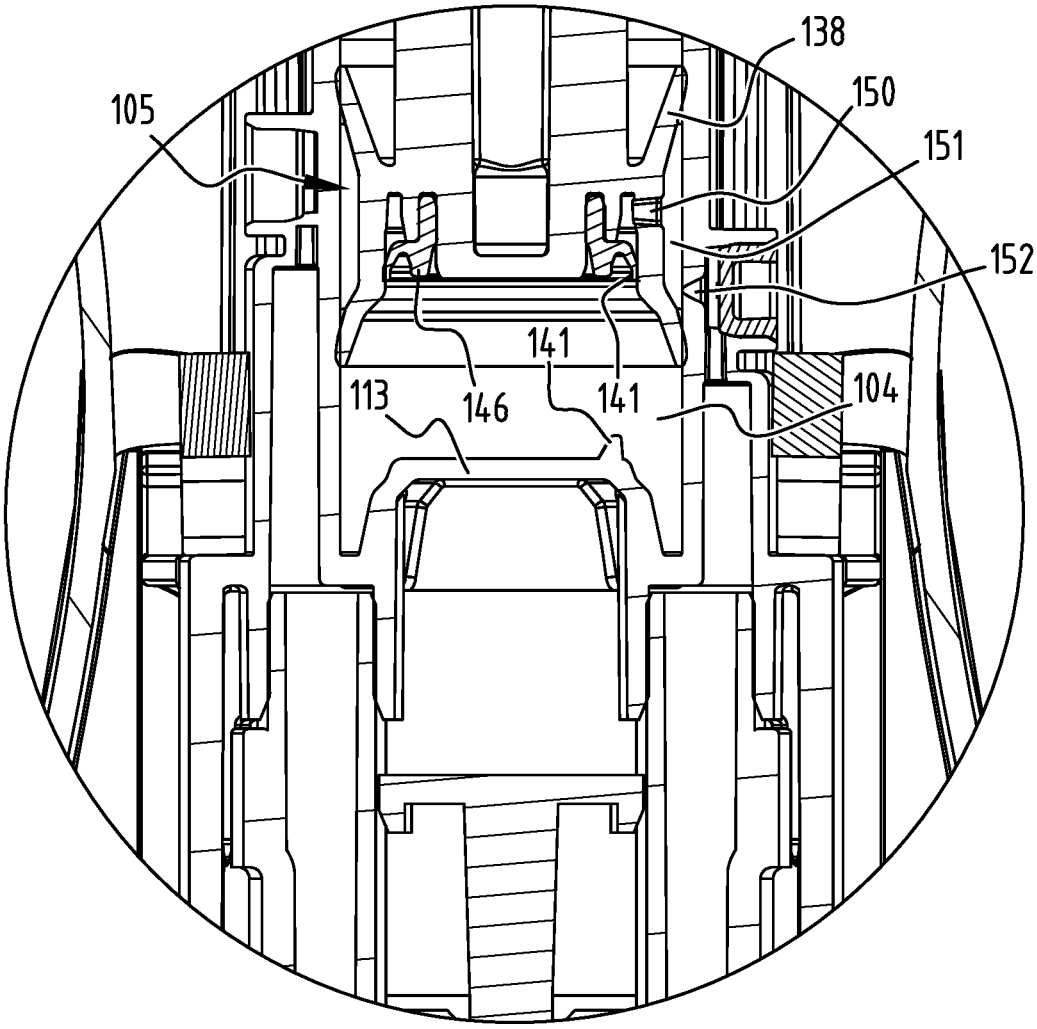
FIG. 16 is a detailed view of the part indicated by circle XVI in FIG. 15, with the piston in a raised position prior to priming.
Figure 17:
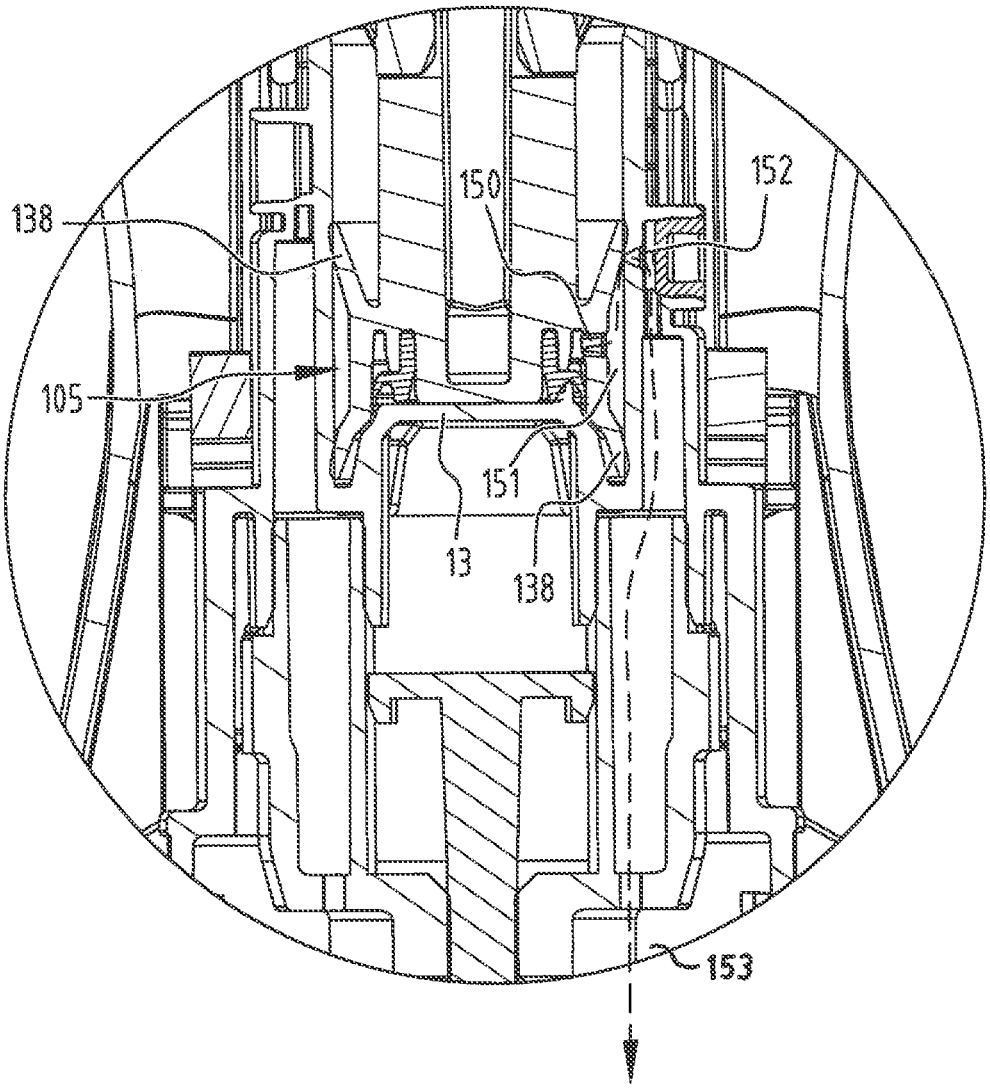
FIG. 17 is a view corresponding to FIG. 16 but showing the piston in its lowermost position during priming.

This alternative embodiment of the liquid dispensing device 101 may use the same type of separate prime valve 140 as the first embodiment (FIG. 16). Here again, a single operating member 141 protrudes from the bottom 113 of the piston chamber to engage the actuating part 146 and deform the sealing part 144. After passing the prime valve 140 the air escapes through the orifice 150 in the piston, the opening 152 in the wall of the housing 108 and flows into the headspace 153 (FIG. 17).

Figure 18:
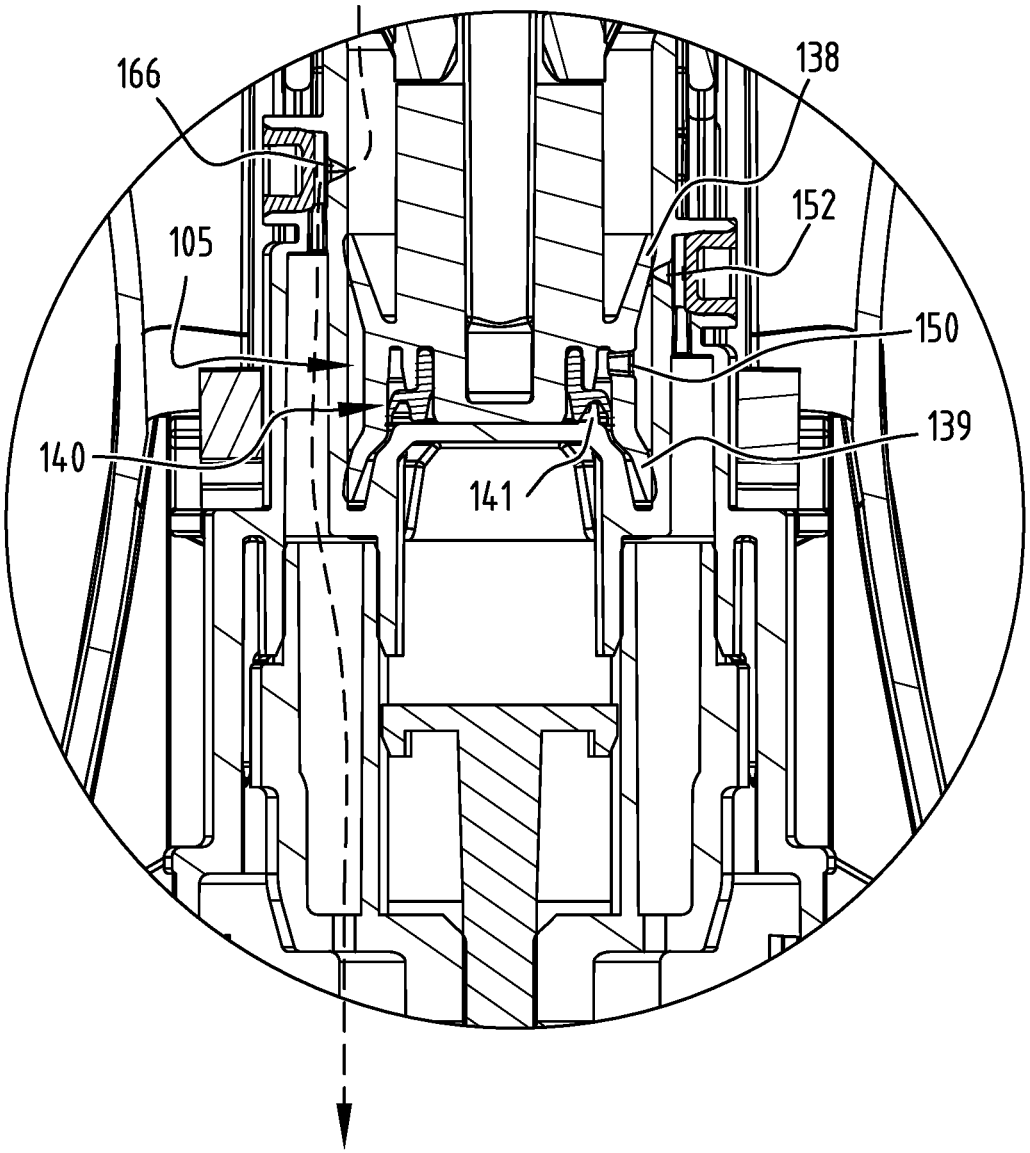
FIG. 18 is a view corresponding with FIG. 17 and showing how a container may be vented.

When the alternative embodiment of the device 101 is used in combination with a conventional single wall container, a venting opening 166 may be formed in the wall of the housing at a higher level than the priming opening 152, just like in the first embodiment (FIG. 18). This allows ambient air to be drawn into the container 103 after a pressurizing stroke.

The above-presented description and figures are intended by way of example only and are not intended to limit the present invention in any way except as set forth in the following claims. It is particularly noted that the persons skilled in the art can readily combine the various technical aspects of the various exemplary embodiments described.

What is claimed:

1. A liquid dispensing device comprising:

a piston chamber;

a piston that is moveable within the piston chamber to pressurize a liquid to be dispensed, the piston having an upper seal and a lower seal;

a nozzle with a defined throughput for dispensing the liquid;

an outlet valve having a defined minimum opening pressure arranged between the piston chamber and the nozzle; and a prime valve for priming the device;

wherein:

the prime valve is mechanically operable and is arranged on or in the piston;

the liquid dispensing device further comprises an operating member in the piston chamber which is arranged to move the prime valve from a closed position to an open position when the piston is near or at an end of a piston stroke, wherein the operating member protrudes from an end wall of the piston chamber; and the prime valve comprises:

a sealing part arranged radially inward of the piston upper and lower seals and closing off an orifice in the piston, said orifice opening onto a peripheral sidewall of the piston; and an actuating part connected to the sealing part and arranged to cooperate with the operating member.

2. The liquid dispensing device of claim 1, wherein the operating member comprises a plurality of operating members.

3. The liquid dispensing device of claim 1, wherein the sealing part is deformable together with the actuating part when the actuating part is engaged by the operating member.

4. The liquid dispensing device of claim 1, wherein an end wall of the piston chamber and/or the piston comprises an air flow path leading to the prime valve.

5. The liquid dispensing device of claim 1, wherein the prime valve is arranged to be biased towards an open position when a pressure in the piston chamber exceeds a predetermined value.

6. The liquid dispensing device of claim 5, wherein the sealing part is oriented away from an end wall of the piston chamber.

7. The liquid dispensing device of claim 1, wherein the prime valve is arranged to be biased towards a closed position by a pressure in the piston chamber.

8. The liquid dispensing device of claim 7, wherein the sealing part is oriented towards an end wall of the piston chamber.

9. The liquid dispensing device of claim 1, wherein the piston chamber is cylindrical, the piston has a circular circumference and the prime valve is annular, the sealing part of the prime valve being formed by an outer peripheral edge portion thereof.

10. The liquid dispensing device of claim 9, wherein the actuating part comprises an annular rim that is concentric with the sealing part and has a smaller diameter than the sealing part.

11. The liquid dispensing device of claim 1, wherein the sealing part and the actuating part have substantially parallel orientations.

12. The liquid dispensing device of claim 1, wherein the sealing part and the actuating part have substantially opposite orientations.

13. The liquid dispensing device of claim 1, further comprising a return opening in a side wall of the piston chamber, wherein the piston lower seal is configured for sealing a part of the piston chamber between the piston and a piston chamber end wall and the piston upper seal is spaced apart from the piston lower seal, such that when the piston is at or near an end of the piston stroke the return opening is located between the piston upper and lower seals.

14. The liquid dispensing device of claim 13, further comprising a vent opening in the side wall of the piston chamber, wherein when the piston is at or near an end of the piston stroke the piston upper and lower seals are located between the vent opening and the piston chamber end wall.

15. The liquid dispensing device of claim 1, wherein the outlet valve is configured to minimize a difference between a valve opening pressure and its closing pressure.

16. The liquid dispensing device of claim 15, wherein the outlet valve comprises a dome and wherein the dome has a stiffness which varies in a radial direction.

17. The liquid dispensing device of claim 16, wherein the outlet valve has an inner flexible portion surrounding a center of the outlet valve and an outer stiffer portion.

18. The liquid dispensing device of claim 17, wherein the outlet valve is thinnest in the inner flexible portion, having a radius $R_1$, and gets thicker as the radius increases beyond $R_1$.

19. The liquid dispensing device of claim 1, further comprising a buffer arranged between the piston chamber and the outlet valve.

20. The liquid dispensing device of claim 1, further comprising a container for the liquid to be dispensed, the container being in fluid communication with the piston chamber through an inlet valve.

* * * * *